US009030364B2

(12) United States Patent
Zhuang

(10) Patent No.: US 9,030,364 B2
(45) Date of Patent: May 12, 2015

(54) DUAL-POLARIZED MICROSTRIP ANTENNA

(76) Inventor: Kunjie Zhuang, Quanzhou (CN)

( * ) Notice: Subject to any disclaimer, the term of this patent is extended or adjusted under 35 U.S.C. 154(b) by 87 days.

(21) Appl. No.: 13/639,958

(22) PCT Filed: Apr. 19, 2011

(86) PCT No.: PCT/CN2011/000682
§ 371 (c)(1),
(2), (4) Date: Oct. 8, 2012

(87) PCT Pub. No.: WO2011/124094
PCT Pub. Date: Oct. 13, 2011

(65) Prior Publication Data

US 2013/0044035 A1 Feb. 21, 2013

(30) Foreign Application Priority Data

| | | |
|---|---|---|
| Sep. 7, 2010 | (CN) | 2010 2 0520059 |
| Sep. 7, 2010 | (CN) | 2010 2 0520071 |
| Sep. 7, 2010 | (CN) | 2010 2 0520077 |
| Sep. 7, 2010 | (CN) | 2010 2 0520086 |
| Sep. 7, 2010 | (CN) | 2010 2 0520090 |
| Sep. 7, 2010 | (CN) | 2010 2 0520101 |
| Sep. 7, 2010 | (CN) | 2010 2 0520113 |
| Nov. 2, 2010 | (CN) | 2010 1 0529416 |

(51) Int. Cl.

| | |
|---|---|
| ***H01Q 13/10*** | (2006.01) |
| ***H01Q 21/06*** | (2006.01) |
| ***H01Q 5/00*** | (2006.01) |
| ***H01Q 9/04*** | (2006.01) |

(52) U.S. Cl.
CPC ..... *H01Q 21/065* (2013.01); *H01Q 5/0093* (2013.01); *H01Q 9/0428* (2013.01); *H01Q 9/0457* (2013.01)

(58) Field of Classification Search
CPC ... H01Q 9/0428; H01Q 9/0457; H01Q 13/10; H01Q 5/0003; H01Q 5/0093
USPC ..... 343/770, 700 MS, 872
See application file for complete search history.

(56) References Cited

U.S. PATENT DOCUMENTS

| | | | | |
|---|---|---|---|---|
| 7,327,317 | B2 | 2/2008 | Heiniger | |
| 7,508,346 | B2 | 3/2009 | Rao et al. | |
| 7,864,117 | B2 * | 1/2011 | Aurinsalo et al. | 343/700 MS |
| 8,482,475 | B2 * | 7/2013 | Tiezzi et al. | 343/824 |

(Continued)

FOREIGN PATENT DOCUMENTS

| | | |
|---|---|---|
| CN | 2329091 Y | 7/1999 |
| CN | 2492989 Y | 5/2002 |

(Continued)

*Primary Examiner* — Hoang V Nguyen
(74) *Attorney, Agent, or Firm* — The Webb Law Firm

(57) ABSTRACT

A dual-polarized microstrip antenna includes: at least one metal radiating patch, i.e. a first metal radiating patch; at least one ground metal layer whereon excitation micro-slots are etched; at least one dielectric layer, i.e. a first dielectric layer it is preferred that the dielectric layer is a resonant dielectric layer such as a resonant dielectric layer of air or other layers of optimization resonant materials; at least one set of bipolar excitation microstrip lines; the dielectric layer is between the first metal radiating patch and the ground metal layer. The dual-polarized microstrip antenna of multi-layer radiation structure is designed in a relatively small volume, which effectively saves the cost of antenna installation and maintenance, and is widely applied in the fields of mobile communication and internet technology.

31 Claims, 12 Drawing Sheets

(56) References Cited

U.S. PATENT DOCUMENTS

| | | | |
|---|---|---|---|
| 2002/0159118 | A1 | 10/2002 | Hiramatsu et al. |
| 2005/0184921 | A1 | 8/2005 | Roberts et al. |
| 2010/0222051 | A1 | 9/2010 | Watanabe et al. |
| 2011/0001682 | A1 | 1/2011 | Rao |

FOREIGN PATENT DOCUMENTS

| | | | |
|---|---|---|---|
| CN | 2783548 | Y | 5/2006 |
| CN | 101389124 | A | 3/2009 |
| CN | 101562817 | A | 10/2009 |
| CN | 201536151 | U | 7/2010 |
| CN | 101916910 | A | 12/2010 |
| CN | 201689984 | U | 12/2010 |
| JP | 20085468 | A | 1/2008 |
| KR | 1020090102459 | B1 | 9/2009 |
| TW | 490888 | B | 6/2002 |
| WO | 0014921 | A1 | 3/2000 |
| WO | 0171944 | A1 | 9/2001 |
| WO | 03023901 | A1 | 3/2003 |
| WO | 2009031184 | A1 | 3/2009 |

* cited by examiner

DUAL-POLARIZED MICROSTRIP ANTENNA

BACKGROUND OF THE INVENTION

1. Field of the Invention

The invention relates to an antenna device, in particular a small microwave low-band multi-frequency high-gain dual-polarized microstrip antenna. Embodiments disclose a microwave antenna with a multi-excitation and multi-layer tuning mechanism, belonging to the technical field of antennas for signal transmission and mobile communication as well as the wireless Internet.

2. Description of Related Art

With the rapid development of mobile communication and Internet technologies, a good number of new hot technologies have emerged in recent years, such as mobile Internet, WLAN, MAN and Internet of Things, indicating an urgent need to adopt the multi-antenna technology (e.g. MIMO technology) to enhance the quality and speed of data transmission of wireless communication channels. The present microwave antenna, with the defects of low work efficiency, clumsiness and difficulty in installation and maintenance, is far from meeting the requirements of the development of mobile communication technology for antenna technology.

First, products publicly advertised, presented, sold and applied at domestic and abroad cannot meet the technical requirements in operators' new-generation communication standards. In addition, present products have the defects of large size, heavy weight, low vertical HPBW, low gain, etc. As shown in Table 1, among present products, the 8-channel TD-SCDMA dual-polarized smart antenna adopted by CMCC (China Mobile Communications Corporation), the world's largest mobile communication operator serving 520 million mobile phone users, has the defects of large size, heavy weight, low radiation efficiency, etc., and therefore can meet neither customer market's new demands in terms of appearance and psychological acceptance nor communication operators' technical requirements.

TABLE 1

Specifications of Present Product

| Name | 8-channel dual-polarized smart antenna adopted by China Mobile (HT355000) | 8-channel dual-polarized smart antenna according to the embodiment of the invention MM-TD2814-1 |
|---|---|---|
| Frequency range | 1,880-2,025 MHz | 1,880-2,025 MHz |
| Dimensions (mm) | 1,480*300*150 | 400*420*35 |
| Weight (kg) | 18-20 | ≤5 |

Second, similar microwave antennas mentioned in literature published at domestic and abroad also have the technical defects of large size, heavy weight, low vertical HPBW, low gain, etc.

For example, CN200710145376.1 relates to a multi-antenna mode selection method during relay network cell switch. CN200910085526.3 relates to a relay transmission method based on antenna beam overlapping. CN201010222613.1 relates to a base station antenna and a base station antenna unit. KR27919/08 relates to a device for processing signals in a distributed antenna system and a method. JP144655/06 relates to an antenna device. PCT/JP2007/000969 relates to a self-adaptive multi-antenna mobile communication system. JP144655/06 relates to an antenna device. U.S. 60/545,896 relates to an antenna module. PCT/US2002/028275 relates to a base station antenna array. PCT/JP01/02001 relates to an array antenna base station device. PCT/US99/19117 relates to a technology combining channel coding with space-time coding principle to enhance antenna performance. US20110001682, U.S. Pat. Nos. 7,508,346 and 7,327,317 relate to dual-polarized microstrip antennas. These antenna-related technologies can meet neither the design requirements for antennas to attain small size, small weight, high gain and adjustable VSWR, nor the performance requirements and technical standards for new-generation TDSCDMA and LTE antennas set by CMCC.

SUMMARY OF THE INVENTION

This invention aims to overcome the defects of the traditional microwave low-band (300 MHz-6 GHz) microstrip antenna, and to provide a small microwave low-band multi-frequency high-gain dual-polarized microstrip antenna featuring wide working band, high gain, excellent cross polarization isolation, small size and light weight.

This invention adopts the following technical scheme:

A dual-polarized microstrip antenna includes:

at least one metal radiating patch, i.e. a first metal radiating patch;

at least one ground metal layer whereon at least one set of bipolar excitation micro-slots are etched;

at least one dielectric layer, i.e. the first dielectric layer; it is preferred that the dielectric layer is a resonant dielectric layer, particularly a resonant dielectric layer of air or a layer of other optimization resonant materials; the dielectric layer is positioned between the first metal radiating patch and the ground metal layer; and at least one set of bipolar excitation microstrip lines.

A VSWR independent adjustment unit connected with the first metal radiating patch is arranged, and it is preferred that the metal radiating patch is circular, so that when the metal radiating patch is adjusted, only the height parameter of the structural relationship between the metal radiating patch and other radiation tuning mechanisms is changed, rather than other parameters that are likely to affect the radiation effects of the antenna. As a result, the VSWR adjustment is simplified and facilitated during manufacture.

The excitation micro-slots are two discretely vertical H-shaped excitation micro-slots with the same dimensions, that is, the two H-shaped excitation micro-slots are not in contact. In addition, it is preferred that the H-shaped excitation micro-slots are identical in dimensions which are related to the central frequency band wavelength λ of the resonance radiation required by the antenna and used to ensure that the dual-polarized antenna has consistent radiation performance optimization in two polarization directions. Meanwhile, it is preferred that the cross arms "-" of the two H-shaped excitation micro-slots are mutually vertical for the purpose of guaranteeing excellent polarization isolation of the dual-polarized antenna. Experiment proves that the preferred design can ensure the planned isolation exceeds 25-30 dBi.

In practical sense, the dual-polarized microstrip antenna according to the invention is a microwave antenna with a multi-excitation and multi-layer tuning mechanism.

The thickness of the first dielectric layer ranges from 1 to 20 mm, and experiment proves that the source input end of the antenna achieves the optimal VSWR of less than 1.2 when the thickness ranges from 4 to 10 mm at the frequency band of 2 GHz-3 GHz; a dielectric substrate 6 is arranged between the bipolar excitation microstrip lines and the ground metal layer. According to the basic theory of microstrip lines, and taking into account the impact of dielectric constant and thickness of the dielectric layer on the width and length of the excitation microstrip lines and the excitation micro-slots, the thickness of the dielectric substrate ranges from 0.2 to 5 mm and is preferred to range from 0.5 to 2 mm.

Front ends of the two excitation microstrip lines are linear. It is preferred that the front end of each excitation microstrip line is vertical to the cross arm "-" of one H-shaped excitation micro-slot, and the front ends pass through the middle points of the cross arms "-" of the respective H-shaped excitation micro-slots; the front ends of the two excitation microstrip lines are discretely vertical for the purposes of guaranteeing the polarization isolation of the dual-polarized antenna and leading it to be used as two independent antennas; the distance between the two discrete front ends which are not in contact ranges from 3 to 8 mm; and the perpendicularity between the two discrete front ends which are not in contact is 90°. Simulation and experiment results prove that the above design and optimal design data can achieve a better radiation efficiency (gain) of 8-8.5 dBi and a polarization isolation of 25-30 dBi or above.

The two H-shaped excitation micro-slots are identical in size, width, slot depth, slot width and shape; it is preferred that two ends of the single cross arm "-" of each H-shaped excitation micro-slot intersect with the middle points of the two vertical arms "|"; it is preferred that the single cross arm "-" and the two vertical arms "|" of each H-shaped excitation micro-slot are linear; it is preferred that the single cross arm "-" of each H-shaped excitation micro-slot is vertical to the two vertical arms "|" thereof; it is preferred that the virtual extension line of the cross arm "-" of at least one H-shaped excitation micro-slot squarely passes through the middle point of the cross arm "-" of the other H-shaped excitation micro-slot; it is preferred that at least one straight line passing through the central point of the first metal radiating patch is positioned on the vertical surface of the cross arm "-" of at least one H-shaped excitation micro-slot, the vertical surface squarely passes through the middle point of the cross arm "-" of the other H-shaped excitation micro-slot, and the vertical surface is vertical to the plane on which the slot bottom of the former H-shaped excitation micro-slot is positioned; it is preferred that the slot bottoms of the two H-shaped excitation micro-slots are on the same plane and the slot surfaces of the two H-shaped excitation micro-slots are on the same plane; in an area of the same shape and size on the ground metal layer vertically projected by the first metal radiating patch, it is preferred that each H-shaped excitation micro-slot independently occupies half the area of the same shape and size, each H-shaped excitation micro-slot, the length of the cross arm "-" of each H-shaped excitation micro-slot or the total length of the cross arm "-" and the two vertical arms "|" of each H-shaped excitation micro-slot is maximized, and the total slot area of the cross arm "-" and the two vertical arms "|" of each H-shaped excitation micro-slot is maximized, so as to capitalize on effective area to ensure the antenna is of small size. Simulation and experiment results prove that the above design and optimal design data can achieve the optimal radiation efficiency (e.g. antenna gain), with the antenna unit gain ranging from 8 to 8.5 dBi.

A second dielectric layer is arranged. It is preferred that the second dielectric layer is a resonant dielectric layer, particularly a resonant dielectric layer of air or a layer of other optimization resonant materials.

According to frequency band, wavelength, the basic theory of microwave electromagnetic field and the basic theory of microstrip micro-slots, the radiation-related parameters of the radiating patch, the dielectric layers and the ground metal layer, such as height, thickness and length, are selected through simulations and experiments.

A second metal radiating patch is arranged and used for enlarging the radiation frequency bandwidth of the antenna or achieving the double-humped resonance between adjacent frequency bands; it is preferred that the second metal radiating patch is identical to the first metal radiating patch in material, thickness and shape; it is preferred that the size of the second metal radiating patch is freely optimized according to the requirements for widening the frequency band; it is preferred that the size relationship between the second metal radiating patch and the first metal radiating patch is subject to the relative relationship between the working frequency band and the widened frequency band, that is, a higher frequency results in a smaller area, and the comprehensive results of experiments and simulations show that the size ratio of the two patches approximately equals the center frequency wavelength ratio of two adjacent frequency bands to be widened; and it is preferred that the second metal radiating patch is arranged above the second dielectric layer so as to separate the first dielectric layer into two areas, where the lower part is preferred to be the slot cavity and the upper part is preferred to be a first dielectric layer area between the first and the second metal radiating patches. Experimental results prove that the addition of the second metal radiating patch can effectively enlarge the frequency bandwidth of the antenna by over 20%.

An air dielectric layer, namely air dielectric layer A, is arranged, which provides an undisturbed work space height for the excitation microstrip lines interfaced with a source. According to the basic theory of microwave electromagnetic field, the work space height needs to be more than 3-10 times of the thickness of the first dielectric substrate, and a smaller dielectric constant of the dielectric substrate leads to a larger multiple; it is preferred that a metal reflection ground baseplate is arranged and used for providing excellent backward radiation isolation for radiating units and providing convenient system ground for source parts, feed source parts or radiating units.

The dual-polarized microstrip antenna of the invention can act as an antenna unit which is connected through a two-way power divider. The connected body includes two dual-polarized antenna units. In each dual-polarized antenna unit, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom, that is, opposite to the direction of microwave radiation.

The first metal radiating patch is connected with an antenna cover through an insulation screw, a ground metal patch covers the upper end surface of the first dielectric substrate and is fixedly connected with a hollow metal support fixed on the metal reflection baseplate, bipolar excitation microstrip lines, of which the front ends are orthogonal but not in contact, are arranged on the lower end surface of the first dielectric substrate, and two bipolar stimulated radiation micro-slots, orthogonal but not in contact, are formed on the upper end surface of the ground metal patch and are corresponding to the front ends of the bipolar excitation microstrip lines in an orthogonal way. Experiment proves that the above orthogonal and vertical correspondence relationships can achieve excellent dual polarization characteristics, that is, high polarization isolation.

The dual-polarized microstrip antenna of the invention can act as an antenna unit which is connected through a four-way power division network. The connected body includes four dual-polarized antenna units connected together through the four-way power division network in an antenna cover. The four dual-polarized antenna units are distributed in a line in the antenna cover. In each dual-polarized antenna unit, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom.

The first metal radiating patch is connected with the antenna cover through an insulation screw, a ground metal patch covers the upper end surface of the first dielectric substrate and is fixedly connected with a hollow metal support fixed on the metal reflection baseplate, bipolar excitation microstrip lines, of which the front ends are orthogonal but not in contact, are arranged on the lower end surface of the first dielectric substrate, and two bipolar stimulated radiation micro-slots, orthogonal but not in contact, are formed on the upper end surface of the ground metal patch and are corresponding to the front ends of the bipolar excitation microstrip lines in an orthogonal way.

The dual-polarized microstrip antenna of the invention can act as an antenna unit which is connected through a four-way power division network. The connected body includes four dual-polarized antenna units connected together through the four-way power division network in an antenna cover. The four dual-polarized antenna units are distributed in two lines and two rows in the antenna cover. In each dual-polarized antenna unit, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom.

The first metal radiating patch is connected with the antenna cover through an insulation screw, the ground metal patch covers the upper end surface of the first dielectric substrate and is fixedly connected with a hollow metal support fixed on the metal reflection baseplate, bipolar excitation microstrip lines, of which the front ends are orthogonal but not in contact, are arranged on the lower end surface of the first dielectric substrate, and two bipolar stimulated radiation micro-slots, orthogonal but not in contact, are formed on the upper end surface of the ground metal patch and are corresponding to the front ends of the bipolar excitation microstrip lines in an orthogonal way.

The invention further discloses a dual-polarized microstrip antenna, which is characterized by including two independent dual-polarized antennas in an antenna cover, said dual-polarized antenna includes two dual-polarized antenna units connected together through a two-way power divider, in each dual-polarized antenna unit, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom.

The first metal radiating patch is connected with the antenna cover through an insulation screw, the ground metal patch covers the upper end surface of the first dielectric substrate and is fixedly connected with a hollow metal support fixed on the metal reflection baseplate, bipolar excitation microstrip lines, of which the front ends are orthogonal but not in contact, are arranged on the lower end surface of the first dielectric substrate, and two bipolar stimulated radiation micro-slots, orthogonal but not in contact, are formed on the upper end surface of the ground metal patch and are corresponding to the front ends of the bipolar excitation microstrip lines in an orthogonal way.

The invention further discloses a dual-polarized microstrip antenna, which is characterized by including eight dual-polarized antenna units connected together through an eight-way power division network in an antenna cover. In each dual-polarized antenna unit, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom.

The first metal radiating patch is connected with the antenna cover through an insulation screw, the ground metal patch covers the upper end surface of the first dielectric substrate and is fixedly connected with a hollow metal support fixed on the metal reflection baseplate, bipolar excitation microstrip lines, of which the front ends are orthogonal but not in contact, are arranged on the lower end surface of the first dielectric substrate, and two bipolar stimulated radiation micro-slots, orthogonal but not in contact, are formed on the upper end surface of the ground metal patch and are corresponding to the front ends of the bipolar excitation microstrip lines in an orthogonal way.

The invention further discloses a dual-polarized microstrip antenna, which is characterized by including four independent dual-polarized antennas in an antenna cover. The dual-polarized microstrip antenna is characterized in that each row of dual-polarized antennas includes two dual-polarized antenna units connected together through a two-way power divider. In each dual-polarized antenna unit, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom.

The first metal radiating patch is connected with the antenna cover through an insulation screw, the ground metal patch covers the upper end surface of the first dielectric substrate and is fixedly connected with a hollow metal support fixed on the metal reflection baseplate, bipolar excitation microstrip lines, of which the front ends are orthogonal but not in contact, are arranged on the lower end surface of the first dielectric substrate, and two bipolar stimulated radiation micro-slots, orthogonal but not in contact, are formed on the upper end surface of the ground metal patch and are corresponding to the front ends of the bipolar excitation microstrip lines in an orthogonal way.

The invention further discloses a dual-polarized microstrip antenna, which is characterized by including four independent dual-polarized antennas in an antenna cover. The dual-polarized microstrip antenna is characterized in that each row of dual-polarized antennas includes four dual-polarized antenna units connected together through a four-way power divider. In each dual-polarized antenna unit, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom.

The first metal radiating patch is connected with the antenna cover through an insulation screw, the ground metal patch covers the upper end surface of the first dielectric substrate and is fixedly connected with a hollow metal support fixed on the metal reflection baseplate, bipolar excitation microstrip lines, of which the front ends are orthogonal but not in contact, are arranged on the lower end surface of the first dielectric substrate, and two bipolar stimulated radiation micro-slots, orthogonal but not in contact, are formed on the upper end surface of the ground metal patch and are corresponding to the front ends of the bipolar excitation microstrip lines in an orthogonal way.

The invention further discloses a dual-polarized microstrip antenna, which is characterized by including a first air dielectric layer, a first metal radiating patch, a second air dielectric layer, a ground metal patch, a first dielectric substrate, bipolar excitation microstrip lines, a third air dielectric layer and a metal reflection baseplate sequentially arranged from top to bottom in an antenna cover.

The ground metal patch covers the upper end surface of the first dielectric substrate and is fixedly connected with a hollow metal support fixed on the metal reflection baseplate. Stimulated radiation micro-slots are formed on the upper end surface of the ground metal patch. The first metal radiating patch is circular, where an adjusting screw is fixed in the center, and the first metal radiating patch is fixed through the threaded connection between the adjusting screw and the internal threads in the center of the antenna cover.

A wireless communication relay station employing the dual-polarized microstrip antenna of the invention is characterized by including at least one dual-polarized microstrip antenna, and it is preferred that the input port of the dual-polarized microstrip antenna is connected with the retransmission end of the relay station.

A wireless communication base station employing the dual-polarized microstrip antenna of the invention is characterized by including at least one dual-polarized microstrip antenna.

A communication system and terminal employing the dual-polarized microstrip antenna of the invention is characterized by including at least one piece of equipment equipped with the dual-polarized microstrip antenna. In practical sense, the dual-polarized microstrip antenna of the invention is a microwave antenna with a multi-excitation and multi-layer tuning mechanism.

Specifically, the invention discloses a dual-polarized microstrip antenna, including at least one metal radiating patch, i.e. a first metal radiating patch;

at least one ground metal layer whereon bipolar excitation micro-slots are etched;

at least one dielectric layer, i.e. a first dielectric layer; it is preferred that the dielectric layer is a resonant dielectric layer, particularly a resonant dielectric layer of air or a layer of other optimization resonant materials; the dielectric layer is positioned between the first metal radiating patch and the ground metal layer; and at least one set of bipolar excitation microstrip lines.

A unit connected with the first metal radiating patch for facilitating independent VSWR adjustment is arranged, and it is preferred that the metal radiating patch is circular.

The excitation micro-slots are two discretely vertical H-shaped excitation micro-slots with the same dimensions, that is, the two H-shaped excitation micro-slots are not in contact. In addition, it is preferred that the H-shaped excitation micro-slots are identical in dimensions to ensure that the dual-polarized antenna has consistent radiation performance optimization in the two polarization directions. Meanwhile, it is preferred that the cross arms "-" of the two H-shaped excitation micro-slots are mutually vertical for the purpose of guaranteeing excellent polarization isolation.

The thickness of the dielectric layer ranges from 1 to 20 mm and is preferred to range from 4 to 10 mm; a dielectric substrate 6 is arranged between the bipolar excitation microstrip lines and the ground metal layer. The thickness of the dielectric substrate ranges from 0.2 to 5 mm and is preferred to range from 0.5 to 2 mm.

Front ends of the two excitation microstrip lines are linear. It is preferred that the front end of each excitation microstrip line is vertical to the cross arm "-" of one H-shaped excitation micro-slot, and the front ends pass through the middle points of the cross arms "-" of the respective H-shaped excitation micro-slots; the front ends of the two excitation microstrip lines are discretely vertical for the purposes of guaranteeing the polarization isolation of the dual-polarized antenna and leading it to be used as two independent antennas; the distance between the two discrete front ends which are not in contact ranges from 3 to 8 mm; and the perpendicularity between the two discrete front ends which are not in contact is 90°.

The two H-shaped excitation micro-slots are identical in size, width, slot depth, slot width and shape; it is preferred that two ends of the single cross arm "-" of each H-shaped excitation micro-slot intersect with the middle points of the two vertical arms "|"; it is preferred that the single cross arm "-" and the two vertical arms "|" of each H-shaped excitation micro-slot are linear; it is preferred that the single cross arm "-" of each H-shaped excitation micro-slot is vertical to the two vertical arms "|" thereof; it is preferred that the virtual extension line of the cross arm "-" of at least one H-shaped excitation micro-slot squarely passes through the middle point of the cross arm "-" of the other H-shaped excitation micro-slot; it is preferred that at least one straight line passing through the central point of the first metal radiating patch is positioned on the vertical surface of the cross arm "-" of at least one H-shaped excitation micro-slot, the vertical surface squarely passes through the middle point of the cross arm "-" of the other H-shaped excitation micro-slot, and the vertical surface is vertical to the plane on which the slot bottom of the former H-shaped excitation micro-slot is positioned; it is preferred that the slot bottoms of the two H-shaped excitation micro-slots are on the same plane and the slot surfaces of the two H-shaped excitation micro-slots are on the same plane; in an area of the same shape and size on the ground metal layer vertically projected by the first metal radiating patch, it is preferred that each H-shaped excitation micro-slot independently occupies half the area of the same shape and size, each H-shaped excitation micro-slot, the length of the cross am"-" of each H-shaped excitation micro-slot or the total length of the cross arm "-" and the two vertical arms "|" of each H-shaped excitation micro-slot is maximized, and the total slot area of the cross arm "-" and the two vertical arms "|" of each H-shaped excitation micro-slot is maximized.

A second dielectric layer is arranged. It is preferred that the second dielectric layer is a resonant dielectric layer, particularly a resonant dielectric layer of air or a layer of other optimization resonant materials.

The second dielectric layer is a slot cavity used to prevent the impact among arrays during the arrayed use of the antenna; and the height of the slot cavity depends on the relevance/isolation parameters determined in the ultimate antenna applications.

The slot cavity is preferred to be a cavity formed above the ground metal layer by the metal support for system ground, with the depth ranging from 0.5 to 20 mm; if the first and the second dielectric layers are air layers and no other radiating patches or components are arranged above the second dielectric layer, the first and the second dielectric layers are connected into a whole and the second dielectric layer serves as one part of the first dielectric layer.

Heights and lengths of the radiating patch, the dielectric layers and the ground metal layer are determined based on frequency band and wavelength.

A second metal radiating patch is arranged; it is preferred that the second metal radiating patch is identical to the first metal radiating patch in material, thickness and shape; it is preferred that the size of the second metal radiating patch is freely optimized according to the requirements for widening the frequency band; it is preferred that the size ratio of the two patches approximately equals the corresponding frequency wavelength ratio of frequency bands to be tuned or widened; and it is preferred that the second metal radiating patch is arranged above the second dielectric layer so as to separate the first dielectric layer into two areas, where the lower part is preferred to be the slot cavity and the upper part is preferred to be a first dielectric layer area between the first and the second metal radiating patches.

An air dielectric layer, namely air dielectric layer A, is arranged, which provides an undisturbed work space height for the excitation microstrip lines interfaced with a source. The work space height needs to be more than 3-10 times of the thickness of the first dielectric substrate, and a lower dielectric constant of the dielectric substrate leads to a larger multiple; it is preferred that a metal reflection ground baseplate is arranged and used for providing excellent backward radiation isolation for radiating units and providing convenient system ground for source parts, feed source parts or radiating units.

Specifically, the invention adopts the following technical scheme:

at least one metal radiating patch, i.e. a first metal radiating patch is included; it is preferred that a unit connected with the first metal radiating patch for facilitating independent VSWR adjustment is arranged; it is preferred that the metal radiating patch is circular (the shape of the metal radiating patch is optional: a rectangular or square metal radiating patch is relatively excellent in performance, a circular metal radiating patch is more suitable for production commissioning compensation so as to achieve better comprehensive results, and antenna performance varies with shapes under the same conditions); and the independent VSWR adjustment unit can independently control the metal radiating patch;

at least one ground metal layer whereon bipolar excitation micro-slots are etched is arranged, and the excitation micro-slots are preferred to be two discretely vertical H-shaped excitation micro-slots with the same dimensions, that is, the two H-shaped excitation micro-slots are not in contact. In addition, it is preferred that the H-shaped excitation micro-slots are identical in dimensions so as to ensure that the dual-polarized antenna has consistent radiation performance optimization in the two polarization directions. Meanwhile, it is preferred that the cross arms "-" of the two H-shaped excitation micro-slots are mutually vertical for the purpose of guaranteeing excellent polarization isolation of the dual-polarized antenna; it is preferred that the two H-shaped excitation micro-slots are identical in size, width, slot depth, slot width and shape; it is preferred that two ends of the single cross arm "-" of each H-shaped excitation micro-slot intersect with the middle points of the two vertical arms "|"; it is preferred that the single cross arm "-" and the two vertical arms "|" of each H-shaped excitation micro-slot are linear; it is preferred that the single cross arm "-" of each H-shaped excitation micro-slot is vertical to the two vertical arms "|" thereof; it is preferred that the virtual extension line of the cross arm "-" of at least one H-shaped excitation micro-slot squarely passes through the middle point of the cross arm "-" of the other H-shaped excitation micro-slot; it is preferred that at least one straight line passing through the central point of the first metal radiating patch is positioned on the vertical surface of the cross arm "-" of at least one H-shaped excitation micro-slot, the vertical surface squarely passes through the middle point of the cross arm "-" of the other H-shaped excitation micro-slot, and the vertical surface is vertical to the plane on which the slot bottom of the former H-shaped excitation micro-slot is positioned; it is preferred that the slot bottoms of the two H-shaped excitation micro-slots are on the same plane and the slot surfaces of the two H-shaped excitation micro-slots are on the same plane; in an area of the same shape and size on the ground metal layer vertically projected by the first metal radiating patch, it is preferred that each H-shaped excitation micro-slot independently occupies half the area of the same shape and size, each H-shaped excitation micro-slot, the length of the cross arm "-" of each H-shaped excitation micro-slot or the total length of the cross arm "-" and the two vertical arms "|" of each H-shaped excitation micro-slot is maximized on the terms that all necessary and preferred limited conditions in this section are met, and the total slot area of the cross arm "-" and the two vertical arms "|" of each H-shaped excitation micro-slot is maximized; experiments find that the above preferred double-H structure can significantly improve the effectiveness of the invention; experiments also find that the above preferred technical scheme of maximizing the total slot area of the cross arm "-" and the two vertical arms "|" of each H-shaped excitation micro-slot aims to capitalize on effective area to ensure the antenna is of small size. Simulation and experiment results prove that the above design and optimal design data can achieve the optimal radiation efficiency (i.e. antenna gain), with the antenna unit gain ranging from 8 to 8.5 dBi.

at least one dielectric layer, i.e. a first dielectric layer, is arranged, and it is preferred that the dielectric layer is a resonant dielectric layer of air or a layer of other optimization resonant materials; the dielectric layer is positioned between the first metal radiating patch and the ground metal layer; it is preferred that the thickness of the dielectric layer ranges from 1 to 20 mm, particularly from 4 to 10 mm; and the first dielectric layer is an important component for tuning the VSWR of an antenna source port;

at least one set of bipolar excitation microstrip lines is arranged, it is preferred that the front ends of the two excitation microstrip lines are linear, and it is preferred that the front end of each excitation microstrip line is vertical to the cross arm "-" of one H-shaped excitation micro-slot, and the front ends pass through the middle points of the cross arms "-" of the respective H-shaped excitation micro-slots; the front ends of the two excitation microstrip lines are discretely vertical for the purpose of guaranteeing the polarization isolation of the dual-polarized antenna, and excellent polarization isolation can lead one dual-polarized antenna to be used as two independent antennas; the distance and perpendicularity between the two discrete front ends which are not in contact are among the key parameters affecting the polarization isolation of the dual-polarized antenna, and are preferred to range from 3 to 8 mm and to be 90° respectively;

it is preferred that a second dielectric layer is arranged; it is preferred that the second dielectric layer is a resonant dielectric layer, particularly a resonant dielectric layer of air or a layer of other optimization resonant materials; it is preferred that the second dielectric layer is a slot cavity, which is preferred to be a cavity formed above the ground metal layer by the metal support for system ground; it is preferred that the depth of the slot cavity ranges from 1 to 10 mm; the second dielectric layer is a tuning component participating in frequency band matching and widening, and if the first and the second dielectric layers are air layers and no other radiating patches or components are arranged above the second dielectric layer, the first and the second dielectric layers are connected into a whole and the second dielectric layer serves as one part of the first dielectric layer;

it is preferred that a second metal radiating patch is arranged and used for widening the radiation frequency bandwidth of the antenna or achieving the double-humped resonance between adjacent frequency bands; it is preferred that the second metal radiating patch is provided with a second independent VSWR adjustment unit connected therewith; it is preferred that the size, material, thickness and shape-size relationship of the second metal radiating patch is subject to the relative relationship between the working frequency band and the widened frequency band, that is, a higher frequency results in a smaller area, and the comprehensive results of experiments and simulations show that the size ratio of the two patches approximately equals the center frequency wavelength ratio of two adjacent frequency bands to be widened; it is preferred that the second independent VSWR adjustment unit can independently control the second metal radiating patch; it is preferred that the second metal radiating patch is arranged above the second dielectric layer so as to separate the first dielectric layer into two areas, where the lower part is preferred to be the slot cavity and the upper part is preferred to be a first dielectric layer area between the first and the second metal radiating patches; and experimental results prove that the addition of the second metal radiating patch can effectively expand the frequency bandwidth of the antenna by over 20%;

an air dielectric layer, namely air dielectric layer A, is preferred, which provides an undisturbed work space height for the excitation microstrip lines interfaced with a source. According to the basic theory of microwave electromagnetic field, the work space height needs to be more than 3-10 times of the thickness of the first dielectric substrate, and a lower dielectric constant of the dielectric substrate leads to a larger multiple;

it is preferred that a metal reflection ground baseplate is arranged and used for providing excellent backward radiation isolation for radiating units and providing convenient system ground for source parts, feed source parts or radiating units;

an antenna cover is preferred to be arranged to cover the above components and dielectric layers, and it is preferred that the first metal radiating patch is connected with the antenna cover through a screw; the first metal radiating patch can be connected with the antenna cover or be connected or fixed with the second air slot cavity layer, it is preferred that the first metal radiating patch is connected with the antenna cover through the screw, and it is preferred that the screw is fixedly connected with the center of the first metal radiating patch and is in threaded connection with the antenna cover through an internal threaded hole at the center of the antenna cover; and the screw is used for fixing the height of the ultimately optimized height between the metal radiating patch and the ground metal layer and can fine-tune the height during scale manufacture, so as to compensate various processing and assembly errors to ensure that the antenna achieves the optimized comprehensive design performance;

the antenna cover is a non-metal antenna cover or an antenna cover having no shielding effect or the minimum shielding effect to be ignored from the engineering perspective; the function of the antenna cover is to improve appearance and provide protection, especially against the impact of external environments (such as hot summer, cold winter, cloud, rain, wind, sand, exposure to sunshine and ice, manual touch, collision by birds and animals, etc.) on the internal structure of antenna; and the antenna cover is preferred to be a PVC hood;

it is preferred that the included angle between the middle cross arms "-" of the double H-shaped stimulated radiation micro-slots and the X/Y axis of the ground metal patch is ±45°, so that the source requirements for ±45° dual-polarized antennas can be met; however, ±45° is not the only option; 0/90° is another common option for dual polarization;

the first and the second metal radiating patches are preferred to be rectangular, square, circular or oval sheet metal with stable electrical performance, light weight and low cost, and circular sheet metal is preferred;

the first and the second dielectric layers are preferred to be identical to the ground metal layer in width and to be made of air dielectric, and other dielectric plates with low dielectric loss are also allowable;

the ground metal layer is preferred to form excitation microstrip lines/excitation micro-slot layout with excellent performance at the operating frequency band of the antenna and any PCB layout that has no impact on the performance of the antenna; and it is preferred that the ground metal layer is made of metal materials with excellent electrical conductivity, and copper or aluminum is preferred; and it is preferred that in the forward direction of microwave radiation, an air dielectric layer, namely air dielectric layer B, is arranged on the outer side of the first metal radiating patch, and it is preferred that the air dielectric layer B is positioned between the cover and the first metal radiating patch.

The technical scheme of the invention and the first specific design scheme and the second specific design scheme employing the technical scheme have the following effects:

the effective area of the ground metal patch is fully utilized to enable a set of bipolar micro-slots to share one metal radiating patch;

the dielectric substrate is used to reduce the area of the antenna radiating unit;

the dual-polarized microstrip antenna with a multi-layer radiation structure has the advantages of small volume, ingenious layout and compact structure. Practice proves that the antenna of the invention achieves an operating frequency relative bandwidth of over 20%, with a high gain of above 8.5 dBi and the cross dual polarization isolation ranging from 25 to 30 dB;

a pair of dual-polarized antenna radiating units of the invention can support a 2×2 MIMO system, is easy to form an antenna array, and has the advantages of small size and light weight. Therefore, lower requirements are imposed on the antenna in terms of installation space and load bearing, processing, manufacture, installation and maintenance are relatively convenient, and the cost for installation and maintenance of the antenna is effectively reduced, so that the dual-polarized antenna radiating units can be widely applied in the field of mobile communication and Internet;

compared with the phase I single-polarized smart antenna used in the current 3G network of CMCC, the product of the invention is much shorter by over 75% and lighter by over 70% respectively; and compared with the phase II improved TD-SCDMA dual-polarized smart antenna, the product of the invention is smaller by over 60% and lighter by over 50% respectively;

the product of the invention is thinner, and the thickness of the main body of the antenna is less than 40 mm;

the key approach to the miniaturization of the antenna of the invention is that the gain of a unit element is significantly increased to the point about 2.5 dB higher than that of a folded dipole antenna and other feed sources; especially, after independent tuning, an array antenna achieves a VSWR at or below 1.2, the size accounts for 25%-50% of that of an element antenna and an antenna array with similar performance, and the weight accounts for 30%-50%; it is preferred that the product of the invention comprises 5 to 10 layers, such as an excitation layer, a feed source layer, a resonant tank conversion layer, 1 to 3 tuning radiating layers and a radiation compensation layer. With the structure, a structure of multiple microwave excitation and multi-layer tuning components is realized, and the mechanism of the element antenna is shifted from the conventional line radiation to the surface radiation, so that the radiation efficiency of a unit antenna element is improved and the unit element achieves high gain. The results of simulation computation and experiment prove that the unit antenna element can achieve a gain of up to 8.5 dBi; and the intensive arrangement of the air/dielectric/metal radiating patches of the invention in an extremely small space is designed to expand frequency band and optimize match: through this structural design, the antenna of the invention can be used at double-peak or multi-peak frequency bands (antenna resonance characteristic in the shape of a hump). For operators in which a certain frequency interval exists and multi-frequency use cannot be realized by widening the bandwidth of one conventional antenna, this characteristic ensures that multi-frequency use can be realized in a miniaturized antenna structure, and has excellent economic values.

First Specific Design Scheme of the Invention:

When only one metal radiating patch is arranged, the technical scheme of the invention can be optimized into the following preferred first specific design scheme:

a small microwave low-band multi-frequency high-gain dual-polarized microstrip antenna is characterized in that in an antenna cover, a first air dielectric layer, a first metal radiating patch, a second air dielectric layer, a ground metal layer with bipolar micro-slots, a first dielectric substrate, bipolar excitation microstrip lines, a third air dielectric layer and a metal reflection baseplate are sequentially arranged from top to bottom, that is, opposite to the direction of microwave radiation; in the first specific design scheme, the first air dielectric layer is the air dielectric layer B in the above-mentioned technical scheme of the invention; in the first specific design scheme, the second air dielectric layer is the first dielectric layer in the above-mentioned technical scheme of the invention; and in the first specific design scheme, the third air dielectric layer is the air dielectric layer A in the above-mentioned technical scheme of the invention; and in the first specific design scheme, the first metal radiating patch is connected with the antenna cover through a screw, the lower end surface of the ground metal patch and the upper end surface of the first dielectric substrate are jointed together, the ground metal patch is fixedly connected with a hollow metal support fixed on the metal reflection baseplate, bipolar excitation microstrip lines, of which the front ends are orthogonal but not in contact, are arranged on the lower end surface of the first dielectric substrate, and a set of bipolar simulated radiation micro-slots, orthogonal but not in contact, are formed on the upper end surface of the ground metal patch and are corresponding to the front ends of the bipolar excitation microstrip lines in an orthogonal way.

Second Specific Design Scheme of the Invention:

When at least two metal radiating patches are arranged, the technical scheme of the invention can be optimized into the following preferred second specific design scheme on the basis of the first specific design scheme:

1) A second metal radiating patch and a second dielectric substrate in the second air dielectric layer are provided, the lower end surface of the second metal radiating patch and the upper end surface of the second dielectric substrate are jointed together, the second metal radiating patch is fixedly connected with a hollow metal support fixed on the metal reflection baseplate, and a fourth air dielectric layer, namely the second dielectric layer described in the above technical scheme of the invention, is formed below the second dielectric substrate. This technical design helps further enlarge the working frequency bandwidth of the antenna.

2) A second metal radiating patch and a dielectric substrate holder in the second air dielectric layer are provided, the second metal radiating patch is fixed on the dielectric substrate holder, the dielectric substrate holder is fixed on the hollow metal support, and a fourth air dielectric layer is formed below the second metal radiating patch. This technical scheme also helps further enlarge the working frequency bandwidth of the antenna 3) The screw is fixedly connected with the center of the first metal radiating patch and is in threaded connection with the antenna cover through the internal threaded hole at the center of the antenna cover. This technical scheme has the benefit that the screw can be rotated outside the antenna cover for fine adjustment of the height between the first metal radiating patch and the stimulated radiation micro-slots, so that the VSWR at the I/O port of the antenna can be easily adjusted to match the impedance of the excitation microstrip lines for a higher antenna gain.

4) A third metal radiating patch parallel to the first metal radiating patch is further arranged between the second metal radiating patch and the first metal radiating patch, the third metal radiating patch is insulated from the second metal radiating patch and the hollow metal support, and a fifth air dielectric layer is formed between the third metal radiating patch and the second metal radiating patch.

5) The dual-polarized antenna unit is provided with a third dielectric substrate jointed with the lower end surface of the third metal radiating patch, and the third dielectric substrate is fixed above the second dielectric substrate through an insulation support.

6) The first metal radiating patch is circular, so that the VSWR at the I/O port of the antenna can be easily adjusted to match the impedance of the excitation microstrip lines for a higher antenna gain.

7) The second metal radiating patch is circular or square, so that the VSWR at the I/O port of the antenna can be easily adjusted to match the impedance of the excitation microstrip lines for a higher antenna gain.

8) The two simulated radiation micro-slots on the ground metal patch are identical in dimensions and are both H-shaped, of which the middle cross arms are mutually orthogonal. This technical scheme helps enhance the gain (namely, efficiency of conversion from electromagnetic field to electromagnetic wave or radiation efficiency) of the dual-polarized radiating unit, for the purpose of enabling the antenna unit to achieve high gain in a relatively small size/radiating area.

9) The included angle between the middle cross arms of the two H-shaped stimulated radiation micro-slots and the X/Y axis of the ground metal patch is ±45 ° or 0/90°, so as to achieve ±45° or 0/90° dual-polarized antenna radiation.

The results of the test of the small dual-polarized (±45° polarized) antenna unit of the invention, namely the test of Embodiment 17, show that the gain is about 8.5 dBi, basically the same as the simulation result; the test chart shows that the horizontal and vertical beam widths range from 70 to 75°, and the front-to-rear ratio is above 25 dB. Unlike the conventional half-wave element type antenna, the invention adopts the surface radiation mechanism involving multiple microwave excitation and multi-layer tuning components to achieve a high element gain. A conventional element antenna often achieves an element gain of 5.5 dBi, while the invention achieves 8.5 dBi;

during practical applications, gain enhancement is normally achieved through an array with multiple antenna units; for example, the invention achieves a gain of 14.5 dBi employing an array with 4 dual-polarized units; the antenna of the invention is characterized by superior miniaturization; the size of the antenna of the invention is less than ⅓-⅕ of that of a conventional antenna with the same antenna gain characteristics;

the antenna units of the invention can be flexibly combined to form different array antennas that meet various gain and beam width requirements; the horizontal angle and vertical angle of a unit beam are both 75°, and when antenna units are increased by multiples in different directions, gain is increased by multiples, while beam width is reduced by multiples;

the antenna unit of the invention is characterized by high isolation, and same polarization isolation and different polarization isolation are both larger than 25 dB. When a multi-antenna array is used, the radiation pattern of the array has excellent consistency. The application of the invention in a MiMo antenna produces better results; and due to the adoption of the microstrip excitation model with a plane structure, the port VSWR of the antenna radiating unit feed source of the invention is convenient to commission, so as to facilitate integration with a source circuit.

The above effects are validated by the internal confidential test of actual products. For example, as to the MM-TD2814-AF8 channel dual-polarized smart antenna employed by a TD-SCDMA base station that meets the purpose and technical effects of the invention, the gain of each channel ranges from 14 to 14.5 dBi, the typical dimensions are 405*420*35 $m^3$, the weight is less than 5 kg, and the frontal area is only 0.17 $m^2$. These indexes are far less than those of the commonly-used antenna; the product is easy to conceal and beautify, thereby diminishing the sensitiveness of users; a derrick can be shared for shared station construction so as to reduce investment in network construction; the product is characterized by good repeatability and strong consistency, and is convenient to operate and maintain.

Technical parameters of the MM-TD2814-AF antenna are shown in Table 2 below:

TABLE 2

Key Technical Indexes of TD2814-AF Antenna

| | |
|---|---|
| Name | LK-TD-2814-AF |
| Frequency range | 1,880-2,025 MHz |
| Gain (dBi) | 14.5 ± 0.2 |
| Electrical downtilt | 0° |
| HPBW | Vertical plane >18<br>Horizontal plane >75 |
| Polarization mode | ±45° polarization |
| Front-to-rear ratio | ≥25 |
| Co-polarization isolation (dB) | >30 |
| Cross-polarization isolation (dB) | >30 |
| Input impedance | 50 Ω |
| VSWR | ≤1.4 |
| Port | (4 + 1 + 4)-N |
| Dimensions (mm) | 405*419*34 |
| Weight (kg) | 4.8 |
| Lightning protection | DC ground |
| Maximum anti-wind speed | 200 km/h |
| Working temperature □ | -40 to +60 |
| Waterproof class | 5 A |
| Antenna cover material | ABS |

The antenna of the invention can be applied to any fixed or mobile equipment using microwave antennas, including but not limited to various mobile terminals, such as mobile phones, handheld TV, notebooks, GPS, devices monitoring transport vehicles or road, communication relay station, repeater station and launch pad, and is particularly suitable for application in antenna systems for base stations/distributed base stations/network optimization equipment and others in complex intensive urban areas or groups of high-rise buildings.

BRIEF DESCRIPTION OF THE DRAWINGS

Below is the detailed description of the invention with reference to the attached drawings.

DESCRIPTION OF THE PREFERRED EMBODIMENTS

Embodiment 1: TD-SCDMA Dual-polarized Antenna

Figure 1:
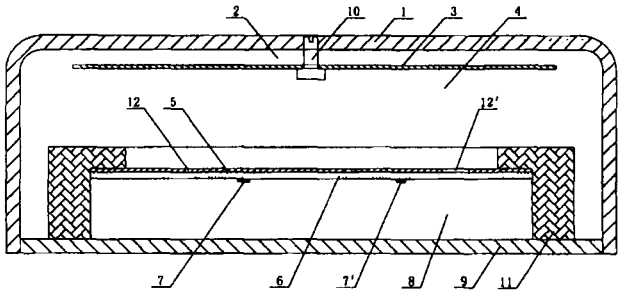
FIG. 1 is the sectional view of Embodiment 1 of the invention.
Figure 2:
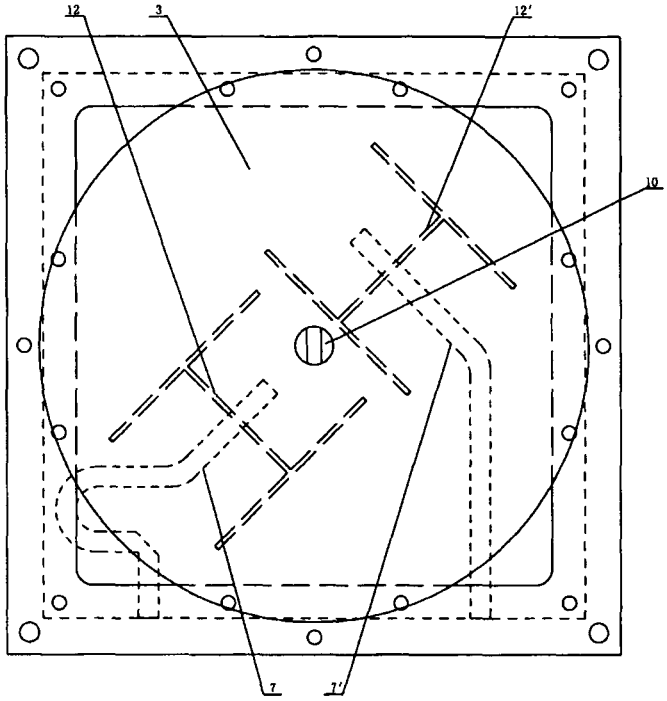
FIG. 2 is the top view of Embodiment 1 of the invention after the antenna cover is removed.

FIG. 1 and FIG. 2 show a small microwave low-band multi-frequency high-gain dual-polarized microstrip antenna according to this embodiment (a TD-SCDMA dual-polarized antenna; TD-SCDMA frequencies of CMCC under a 3G license: 1,880-1,920 MHz and 2,010-2,025 MHz), wherein a first air dielectric layer 2, a first metal radiating patch 3, a second air dielectric layer 4, a ground metal patch 5, a first dielectric substrate 6, bipolar excitation microstrip lines 7, 7', a third air dielectric layer 8 and a metal reflection baseplate 9 are sequentially arranged in an antenna cover 1 from top to bottom. The first metal radiating patch 3 is connected with the antenna cover 1 through a screw 10. The ground metal patch 5 covers the upper end surface of the first dielectric substrate 6, and is fixedly connected with a hollow metal support 11 which is fixed on the metal reflection baseplate 9. The bipolar excitation microstrip lines 7, of which the front ends are orthogonal yet not in contact, are laid on the lower end surface of the first dielectric substrate 6. Two stimulated radiation micro-slots 12, 12', orthogonal but not in contact, are formed on the upper end surface of the ground metal patch 5, and are corresponding to the front ends of the bipolar excitation microstrip lines 7, 7' in an orthogonal way. In this embodiment, the first metal radiating patch 3 is circular, and the screw 10, which is fixedly connected with the center of the first metal radiating patch 3, is also in threaded connection with the antenna cover 1 through an internal threaded hole in the center of the antenna cover. With such configuration, the screw can be rotated outside the antenna cover for fine adjustment of the height between the first metal radiating patch and the stimulated radiation micro-slots, so that the VSWR at the I/O port of the antenna can be easily adjusted to match the impedance of the microstrip lines for a higher antenna gain. The circular metal radiating patch only has height variation during adjustment, so the adjustment is more convenient.

As shown in FIG. 2, the two stimulated radiation micro-slots 12, 12' on the ground metal patch 5 are equal in size and both H-shaped, of which the middle cross arms are orthogonal. Such configuration helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are +45°. Such a technical scheme also helps form the bipolar stimulated radiation micro-slots on the ground metal patch with a smaller area, so as to miniaturize the antenna.

Figure 4:
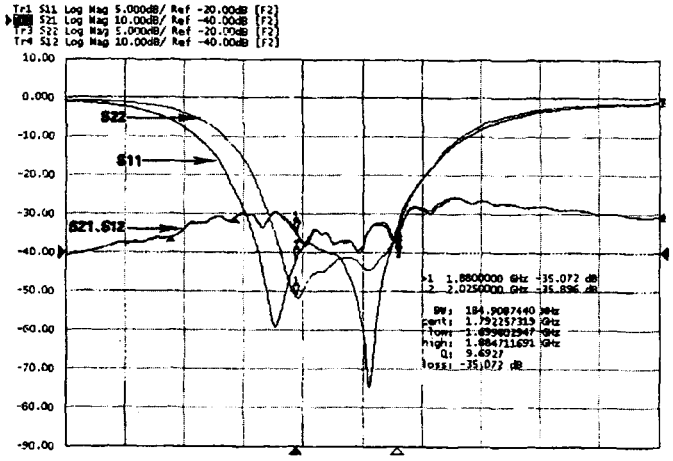
FIG. 4 shows reflection coefficient and isolation test curves of Embodiment 1.

FIG. 4 shows the measured reflection coefficient curves of the antenna, in which S11 is the reflection coefficient of Port 1, and S22 is that of Port 2. We can see that the reflection coefficients of the two dual polarization ports within the TD-SCDMA frequencies are both below −17 dB, with the bandwidth indexes all qualified (relative bandwidth >8%). The figure also shows the measured curve of isolation between the two ports of the dual-polarized antenna, in which the isolation between Port 1 and Port 2 (S21(S12)) is below −32 dB within the bandwidth range. According to test results, the two ports of the dual-polarized antenna are satisfactorily isolated from each other and thus can work independently.

According to actual measurements, the antenna gain is 8.9 dBi at a test frequency of 1,900 MHz, and the theta-plane HPBW is 83°.

Embodiment 2: TD-SCDMA and TD-LTE Antenna

Figure 3:
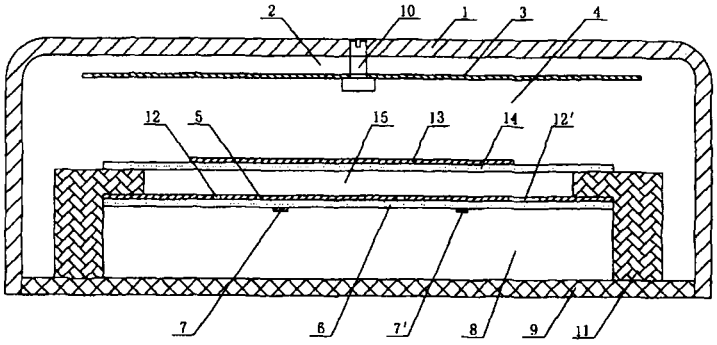
FIG. 3 is the sectional view of Embodiment 2.

FIG. 3 shows a small microwave low-band multi-frequency high-gain dual-polarized microstrip antenna according to this embodiment (coverage: TD-SCDMA and TD-LITE frequencies; WCDMA frequencies: 1,920-1,980 MHz and 2,110-2,170 MHz; TD-SCDMA frequencies: 1,880-1,920 MHz and 2,010-2,025 MHz), which is based on Embodiment 1 and further includes a second metal radiating patch 13 and a second dielectric substrate 14 in the second air dielectric layer 4. The lower end surface of the second metal radiating patch 13 is jointed with the upper end surface of the second dielectric substrate 14 to form as a whole, which is then fixedly connected with the hollow metal support 11 fixed on the metal reflection baseplate 9 to form a fourth air dielectric layer 15 below the second dielectric substrate 14. This configuration helps further enlarge the working frequency bandwidth of the antenna. The second metal radiating patch 13 is circular, so that the VSWR at the I/O port of the antenna can be easily adjusted to match the impedance of the microstrip lines for a higher antenna gain.

Figure 5:
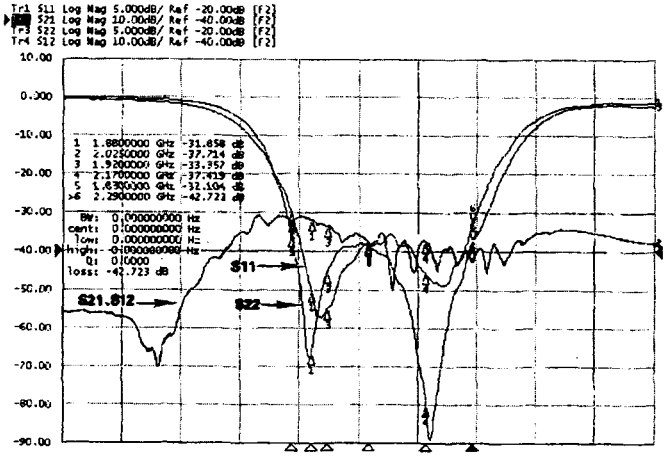
FIG. 5 shows reflection coefficient and isolation test curves of Embodiment 2.

FIG. 5 shows the measured reflection coefficient curves of the antenna, in which the reflection coefficients of the two dual polarization ports within the TD-SCDMA and WCDMA frequencies are both below −17 dB, with the bandwidth indexes all qualified. Due to the additional second radiating patch, the working frequency bandwidth of the antenna is effectively enlarged without changing the bandwidth effect and performance indexes of the original structure with only one radiating patch (relative bandwidth: 22.5%). The figure also shows the measured curve of isolation between the two ports of the dual-polarized antenna, in which the isolation is below −32 dB within the bandwidth range. According to test results, the two ports of the dual-polarized antenna are satisfactorily isolated from each other and thus can work independently.

In a similar technical scheme, the second metal radiating patch and a dielectric substrate holder are arranged in the second air dielectric layer. The second metal radiating patch is fixed on the dielectric substrate holder, which is fixed on the hollow metal support to form the fourth air dielectric layer below the second metal radiating patch. The technical scheme also helps further enlarge the working frequency bandwidth of the antenna.

Figure 6:
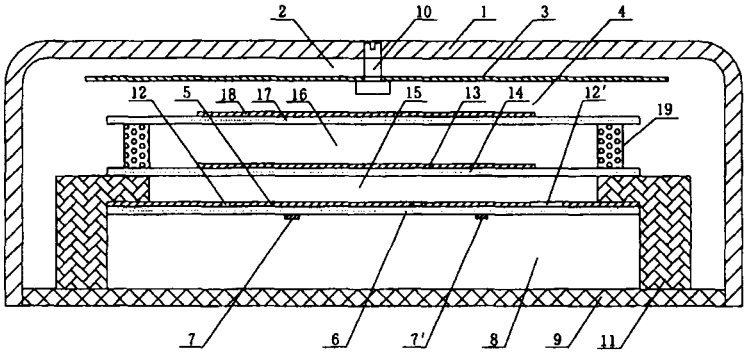
FIG. 6 is the sectional view of Embodiment 3 of the invention.

Embodiment 3: Small Dual-polarized Microstrip Antenna with Three Metal Radiating Patches FIG. 6 shows a small dual-polarized microstrip antenna with three metal radiating patches based on Embodiment 2, in which a third metal radiating patch 18 and a third dielectric substrate 17 are further arranged between the second metal radiating patch 13 and the first metal radiating patch 3. The third metal radiating patch 18 is parallel to the first metal radiating patch 3 and insulated from the second metal radiating patch 13 and the hollow metal support 11. The lower end surface of the third metal radiating patch 18 is jointed with the upper end surface of the third dielectric substrate 17 to form as a whole, which is then fixedly connected with an insulation support 19 fixed on the second dielectric substrate 14 to form a fifth air dielectric layer 16 below the third dielectric substrate 17.

Test results prove that the working bandwidth of the antenna according to Embodiment 3 is further enlarged without changes of the original electric performance indexes of the antenna according to Embodiment 2 (relative bandwidth: about 40%).

In a similar technical scheme, the third metal radiating patch, which is parallel to the first metal radiating patch, is arranged between the second metal radiating patch and the first metal radiating patch and insulated from the second metal radiating patch and the hollow metal support, and the fifth air dielectric layer is formed between the third metal radiating patch and the second metal radiating patch. Such a technical scheme also helps further enlarge the working frequency bandwidth of the antenna.

Embodiment 4: Small Multi-layer Microstrip Antenna with Convenient VSWR Adjustment This embodiment discloses a small multi-layer microstrip antenna with convenient VSWR adjustment, which is characterized in that a first air dielectric layers, a first metal radiating patch, a second air dielectric layer, a ground metal patch, a first dielectric substrate, excitation microstrip lines, a third air dielectric layer and a metal reflection baseplate are sequentially arranged in an antenna cover from top to bottom, the ground metal patch covers the upper end surface of the first dielectric substrate and is fixedly connected with a hollow metal support fixed on the metal reflection baseplate, stimulated radiation micro-slots are formed on the upper end surface of the ground metal patch, and the first metal radiating patch is circular and fixed by the threaded connection between an adjusting screw fixed in its center and the internal threads in the center of the antenna cover.

In this technical scheme, the screw can be rotated outside the antenna cover for fine adjustment of the height between the first metal radiating patch and the stimulated radiation micro-slots, so that the VSWR at the I/O port of the antenna can be easily adjusted to match the impedance of the excitation microstrip lines for a higher antenna gain. The circular first metal radiating patch only has one variable in the adjustment, which makes the adjustment very convenient and fast and therefore greatly improves the productivity.

The technical scheme of this embodiment is described as follows:

1. Bipolar excitation microstrip lines, of which the front ends are orthogonal but not in contact, are arranged on the lower end surface of a first dielectric substrate. Stimulated radiation micro-slots, orthogonal but not in contact, are formed on the upper end surface of a ground metal patch, and are corresponding to the front ends of the bipolar excitation microstrip lines in an orthogonal way. 2. A second metal radiating patch and a second electric substrate are arranged in a second air dielectric layer. The lower end surface of the second metal radiating patch is jointed with the upper end surface of the second dielectric substrate to form as a whole, which is then fixedly connected with a hollow metal support fixed on a metal reflection baseplate to form a fourth air dielectric layer below the second dielectric substrate. The technical scheme helps further enlarge the working frequency bandwidth of the antenna. 3. The second metal radiating patch and a dielectric substrate holder are arranged in the second air dielectric layer. The second metal radiating patch is fixed on the dielectric substrate holder which is fixed on the hollow metal support, so as to form a fourth air dielectric layer below the second metal radiating patch. The technical scheme also helps further enlarge the working frequency bandwidth of the antenna. 4. The second metal radiating patch is circular, so that the VSWR at the I/O port of the antenna can be easily adjusted to match the impedance of the microstrip lines for a higher antenna gain. 5. The two stimulated radiation micro-slots on the ground metal patch are equal in size and both H-shaped, of which the middle cross arms are orthogonal. Such a technical scheme helps form the bipolar stimulated radiation micro-slots on the ground metal patch with a smaller area, so as to miniaturize the antenna. 6. The included angles between the middle cross arms of the two H-shaped stimulated radiation micro-slots and the X/Y axis of the ground metal patch are ±45°. With the technical scheme, the effective area of the ground metal patch can be more fully used for miniaturization of the antenna.

In the utility model, the dual-polarized microstrip antenna and the multi-layer radiation structure are designed in a relatively small space, of which the layout is smart and the structure is compact. It has been proved in practice that the relative working frequency bandwidth of the antenna provided by the utility model can exceed 20%, with a gain increase of 9 dBi and a dual polarization cross-isolation as high as 30 dB; a pair of dual-polarized antenna units are sufficient for a 2×2 MIMO system; and with a small volume and a light weight, the antenna is less demanding in installation space and load bearing and more convenient to manufacture, install and maintain, and can be easily arrayed and effectively save the installation and maintenance costs. Therefore, the antenna can be widely applied in mobile communication and Internet technologies.

FIG. 1 and FIG. 2 show the specific design of the small multi-layer microstrip antenna with convenient VSWR adjustment according to this embodiment. A first air dielectric layer 2, a first metal radiating patch 3, a second air dielectric layer 4, a ground metal patch 5, a first dielectric substrate 6, excitation microstrip lines 7, 7' (bipolar excitation microstrip lines according to this embodiment), a third air dielectric layer 8 and a metal reflection baseplate 9 are sequentially arranged in an antenna cover 1 from top to bottom. The first metal radiating patch 3 is connected with the antenna cover 1 through a screw 10. The ground metal patch 5 covers the upper end surface of the first dielectric substrate 6, and is fixedly connected with a hollow metal support 11 which is fixed on the metal reflection baseplate 9. Two stimulated radiation micro-slots 12, 12' (bipolar stimulated radiation micro-slots according to this embodiment) are formed on the upper end surface of the ground metal patch 5. The first metal radiating patch 3 is circular and fixed by the threaded connection between an adjusting screw 10 fixed in its center and the internal threads in the center of the antenna cover 1. The bipolar excitation microstrip lines 7, of which the front ends are orthogonal yet not in contact, are laid on the lower end surface of the first dielectric substrate 6. The two stimulated radiation micro-slots 12, 12', orthogonal but not in contact, are formed on the upper end surface of the ground metal patch 5, and are corresponding to the front ends of the bipolar excitation microstrip lines 7, 7' in an orthogonal way.

As shown in FIG. 2, the two stimulated radiation micro-slots 12, 12' on the ground metal patch 5 are equal in size and both H-shaped, of which the middle cross arms are orthogonal. Such configuration helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are ±45°. With this technical scheme, the effective area of the ground metal patch can be more fully used for miniaturization of the antenna.

Embodiment 5: Small Multi-layer Microstrip Antenna with Convenient VSWR Adjustment FIG. 3 shows a small multi-layer microstrip antenna with convenient VSWR adjustment according to this embodiment, which is based on Embodiment 4 and further includes a second metal radiating patch 13 and a second dielectric substrate 14 in the second air dielectric layer 4. The lower end surface of the second metal radiating patch 13 is jointed with the upper end surface of the second dielectric substrate 14 to form as a whole, which is then fixedly connected with the hollow metal support 11 fixed on the metal reflection baseplate 9 so as to form a fourth air dielectric layer 15 below the second dielectric substrate 14. The technical scheme helps further enlarge the working frequency bandwidth of the antenna. The second metal radiating patch 13 is circular, so that the VSWR at the I/O port of the antenna can be easily adjusted to match the impedance of the excitation microstrip lines for a higher antenna gain.

In a similar technical scheme, the second metal radiating patch and a dielectric substrate holder are arranged in the second air dielectric layer, the second metal radiating patch is fixed on the dielectric substrate holder, and the dielectric substrate holder is fixed on the hollow metal support to form the fourth air dielectric layer below the second metal radiating patch. The technical scheme also helps further enlarge the working frequency bandwidth of the antenna.

Embodiment 6: Wireless Communication Relay Station with Built-in Antenna

This embodiment adopts the following technical scheme: a wireless communication relay station with a built-in antenna includes a relay station main case and the antenna matched therewith, and is characterized by further including an arc-shaped upper cover of the relay station, in which the antenna is arranged in the arc-shaped upper cover of the relay station and fixedly connected therewith through screws, the input port of the antenna is directly connected with the retransmission end of the relay station, and the arc-shaped upper cover of the relay station is fixedly connected with the relay station main case through screws.

The wireless communication relay station with the built-in antenna according to this embodiment includes the relay station main case and the antenna matched therewith, and is characterized by further including the arc-shaped upper cover of the relay station, in which the antenna is arranged in the arc-shaped upper cover of the relay station and fixedly connected therewith through screws, the input port of the antenna is directly connected with the retransmission end of the relay station, and the arc-shaped upper cover of the relay station is fixedly connected with the relay station main case through screws. The antenna in this embodiment is a multi-layer microstrip antenna, particularly, a small multi-layer dual-polarized microstrip antenna.

The antenna in this embodiment is a ceiling-mounted antenna. This embodiment has the following benefits: the antenna is placed in the main case of the wireless communication relay station to achieve compact structure, fewer connecting cables, low cost and convenient installation; the wireless communication relay station with the built-in antenna is suitable for wireless communication indoor distribution systems, featuring an attractive appearance as well as good transmission performance and high reliability of the antenna.

Embodiment 7: Miniature Dual-polarized Microstrip Antenna

This embodiment adopts the following technical scheme: a miniature dual-polarized microstrip antenna is characterized by including two dual-polarized antenna units which are connected in an antenna cover through a two-way power divider. A first air dielectric layer, a first metal radiating patch, a second air dielectric layer, a ground metal patch, a first dielectric substrate, bipolar excitation microstrip lines, a third air dielectric layer and a metal reflection baseplate are sequentially arranged from top to bottom in each dual-polarized antenna unit. The first metal radiating patch is connected with the antenna cover through an insulation screw. The ground metal patch covers the upper end surface of the first dielectric substrate, and is fixedly connected with a hollow metal support which is fixed on the metal reflection baseplate. The bipolar excitation microstrip lines, of which the front ends are orthogonal yet not in contact, are arranged on the lower end surface of the first dielectric substrate. Two stimulated radiation micro-slots, orthogonal but not in contact, are formed on the upper end surface of the ground metal patch, and are corresponding to the front ends of the bipolar excitation microstrip lines in an orthogonal way.

This embodiment has the following benefits: it achieves the advantages of small volume, compact structure and light weight by integrating microstrip, micro-slot and the multi-layer theory; the antenna has good energy radiation performance and high reliability; with the linear arrangement and a planar emission source, microwave harnesses have better direction selectivity; with the two antenna units, the dual-polarized antenna attains a qualified gain of 11 dBi; microstrip routing inside the antenna helps reduce the consumption of connecting cables and the cost; and the antenna is more convenient to install due to its small volume and light weight. According to tests, the miniature dual-polarized microstrip antenna is totally qualified for operators' relevant requirements on electrical and mechanical performance indexes.

Figure 7:
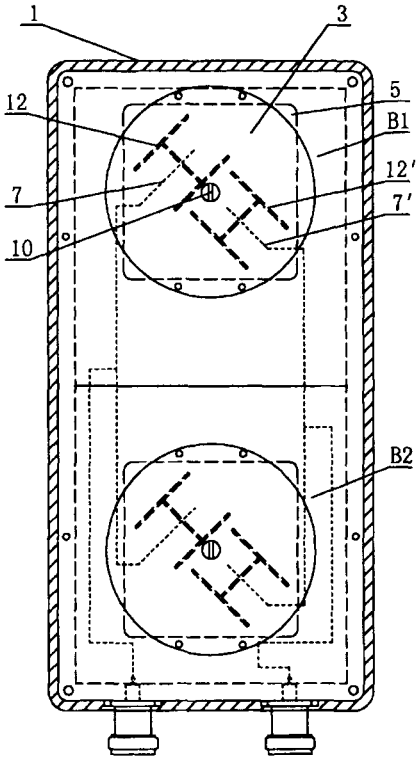
FIG. 7 is the explanatory drawing of Embodiment 7.
Figure 8:
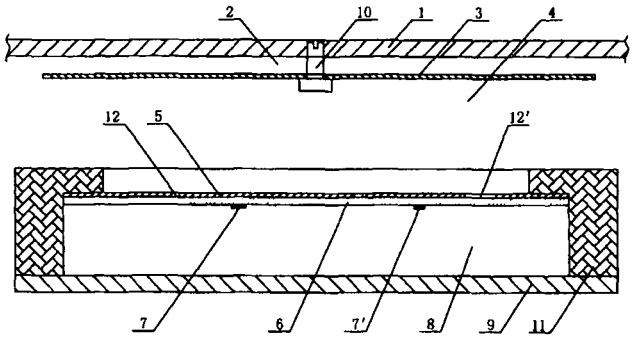
FIG. 8 is the explanatory drawing of Embodiment 8.

A miniature dual-polarized microstrip antenna according to this embodiment, as shown in FIG. 7 and FIG. 8, includes two dual-polarized antenna units (B1, B2) which are connected in an antenna cover 1 through a two-way power divider (Wilkinson equal power divider). As shown in FIG. 2, a first air dielectric layer 2, a first metal radiating patch 3, a second air dielectric layer 4, a ground metal patch 5, a first dielectric substrate 6, bipolar excitation microstrip lines 7, 7', a third air dielectric layer 8 and a metal reflection baseplate 9 are sequentially arranged from top to bottom in each dual-polarized antenna unit (B1, for example). The first metal radiating patch 3 is connected with the antenna cover 1 through an insulation screw 10. The ground metal patch 5 covers the upper end surface of the first dielectric substrate 6, and is fixedly connected with a hollow metal support 11 which is fixed on the metal reflection baseplate 9. The bipolar excitation microstrip lines 7, 7', of which the front ends are orthogonal yet not in contact, are arranged on the lower end surface of the first dielectric substrate 6. Two stimulated radiation micro-slots 12, 12', orthogonal but not in contact, are formed on the upper end surface of the ground metal patch, and are corresponding to the front ends of the bipolar excitation microstrip lines 7, 7' in an orthogonal way. In this embodiment, the first metal radiating patch 3 is circular, and the insulation screw 10, which is fixedly connected with the center of the first metal radiating patch 3, is also in threaded connection with the antenna cover 1 through an internal threaded hole in the center of the antenna cover 1. With such a technical scheme, the screw can be rotated outside the antenna cover for fine adjustment of the height between the first metal radiating patch and the stimulated radiation micro-slots, so that the VSWR at the I/O port of the antenna can be easily adjusted to match the impedance of the microstrip lines for a higher antenna gain. The circular metal radiating patch only has height variations during adjustment, so the adjustment is more convenient.

As shown in FIG. 7, the two stimulated radiation micro-slots 12, 12' on the ground metal patch 5 are equal in size and both H-shaped, of which the middle cross arms are orthogonal. Such a technical scheme helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are ±45°. Such a technical scheme also helps form the bipolar stimulated radiation micro-slots on the ground metal patch with a smaller area, so as to miniaturize the antenna.

According to test results, the gain of the dual-polarized antenna is 11 dBi at a test frequency of 1,900 MHz; the horizontal HPBW is 72°, the vertical HPBW is 36°, and the front-to-rear ratio is below −25 dB; the VSWR at the I/O port is below 1.3, and the relative working frequency bandwidth is around 10%.

Embodiment 8: Miniature Dual-polarized Microstrip Antenna

Figure 9:
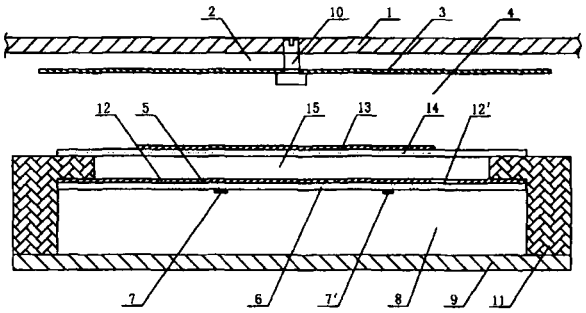
FIG. 9 is the explanatory drawing of Embodiment 9.

FIG. 9 shows a miniature dual-polarized microstrip antenna which is based on Embodiment 7 and further includes a second metal radiating patch 13 and a second dielectric substrate 14 in the second air dielectric layer 4. The second metal radiating patch 13 is parallel to the first metal radiating patch 3. The lower end surface of the second metal radiating patch 13 is jointed with the upper end surface of the second dielectric substrate 14 to form as a whole, which is then fixedly connected with the hollow metal support 11 fixed on the metal reflection baseplate 9 to form a fourth air dielectric layer 15 below the second dielectric substrate 14. This technical scheme helps further enlarge the working frequency bandwidth of the antenna. The second metal radiating patch 13 is circular, so that the VSWR at the I/O port of the antenna can be easily adjusted to match the impedance of the microstrip lines for a higher antenna gain.

Test results show that Embodiment 8 can enlarge the working bandwidth without changing the original electric performance indexes of the antenna according to Embodiment 7 (relative bandwidth: about 25%).

In a similar technical scheme, each dual-polarized antenna unit further includes a second metal radiating patch in the second air dielectric layer and parallel to the first metal radiating patch. The second metal radiating patch is fixed with the hollow metal support in an insulated manner, so that a fourth air dielectric layer is formed between the second metal radiating patch and the ground metal patch. The technical scheme also helps further enlarge the working frequency bandwidth of the antenna, though less remarkably without the second dielectric substrate.

Embodiment 9: Miniature Dual-polarized Microstrip Antenna

Figure 10:
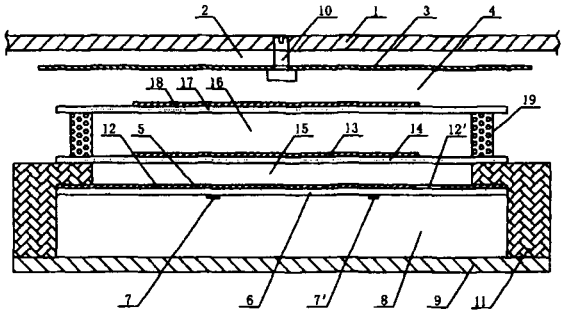
FIG. 10 is the explanatory drawing of Embodiment 10.

FIG. 10 shows a miniature dual-polarized microstrip antenna based on Embodiment 8, in which a third metal radiating patch 18 and a third dielectric substrate 17 are further arranged between the second metal radiating patch 13 and the first metal radiating patch 3. The third metal radiating patch 18 is parallel to the first metal radiating patch 3 and insulated from the second metal radiating patch 13 and the hollow metal support 11. The lower end surface of the third metal radiating patch 18 is jointed with the upper end surface of the third dielectric substrate 17 to form as a whole, which is then fixedly connected with an insulation support 19 fixed on the second dielectric substrate 14 to form a fifth air dielectric layer 16 below the third dielectric substrate 17.

Test results show that Embodiment 9 can further enlarge the working bandwidth without changing the original electric performance indexes of the antenna according to Embodiment 8 (relative bandwidth: about 40%).

In a similar technical scheme, the third metal radiating patch is located between the second radiating patch and the first radiating patch and parallel to the first radiating patch, and is insulated from the second metal radiating patch and the hollow metal support. A fifth air dielectric layer is formed between the third metal radiating patch and the second metal radiating patch. The technical scheme also helps further enlarge the working frequency bandwidth of the antenna, though less remarkably without the third dielectric substrate.

Embodiment 10: Small Dual-polarized Microstrip Antenna

This embodiment adopts the following technical scheme: a small dual-polarized microstrip antenna is characterized by including four dual-polarized antenna units which are connected through a four-way power divider and linearly distributed in an antenna cover. A first air dielectric layer, a first metal radiating patch, a second air dielectric layer, a ground metal patch, a first dielectric substrate, bipolar excitation microstrip lines, a third air dielectric layer and a metal reflection baseplate are sequentially arranged from top to bottom in each dual-polarized antenna unit. The first metal radiating patch is connected with the antenna cover through an insulation screw. The ground metal patch covers the upper end surface of the first dielectric substrate, and is fixedly connected with a hollow metal support which is fixed on the metal reflection baseplate. The bipolar excitation microstrip lines, of which the front ends are orthogonal yet not in contact, are arranged on the lower end surface of the first dielectric substrate. Two stimulated radiation micro-slots, orthogonal but not in contact, are formed on the upper end surface of the ground metal patch, and are corresponding to the front ends of the bipolar excitation microstrip lines in an orthogonal way.

This embodiment has the following benefits: it achieves the advantages of small volume, compact structure and light weight by integrating microstrip, micro-slot and the multilayer theory; the antenna has good energy radiation performance and high reliability; with the linear arrangement and a planar emission source, microwave harnesses have better direction selectivity; with the four antenna units, the dual-polarized antenna attains a qualified gain of 14 dBi; microstrip routing inside the antenna helps reduce the consumption of connecting cables and the cost; and the antenna is more convenient to install due to its small volume and light weight. According to tests, the small dual-polarized microstrip antenna is totally qualified for operators' relevant requirements on electrical and mechanical performance indexes.

Figure 11:
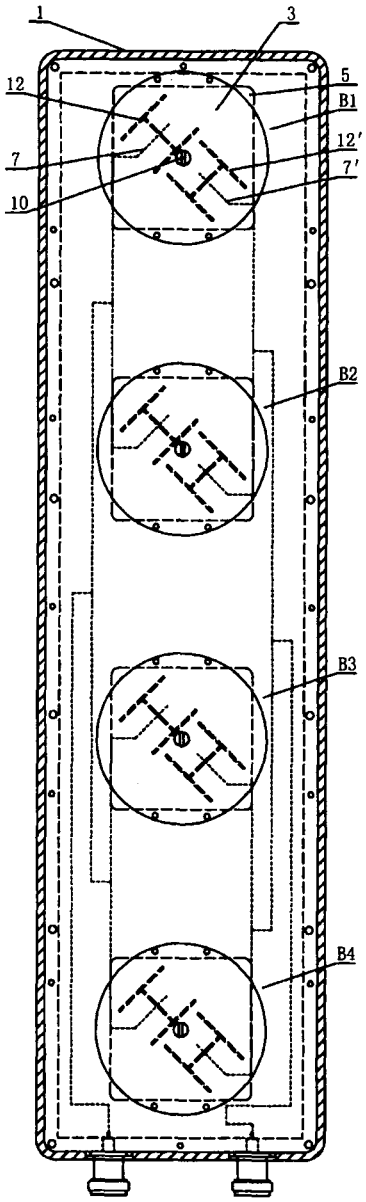
FIG. 11 is the explanatory drawing of Embodiment 11.
Figure 12:
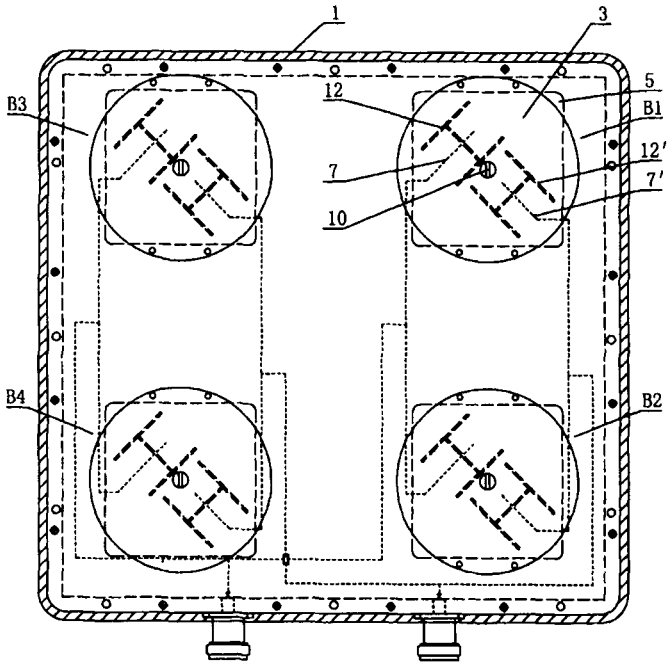
FIG. 12 is the explanatory drawing of Embodiment 12.

A small dual-polarized microstrip antenna according to this embodiment, as shown in FIG. 11 and FIG. 12, includes four dual-polarized antenna units (B1, B2, B3, B4) which are connected through a four-way power divider (series connection of three Wilkinson equal power divider) and linearly distributed in an antenna cover 1. As shown in FIG. 2, a first air dielectric layer 2, a first metal radiating patch 3, a second air dielectric layer 4, a ground metal patch 5, a first dielectric substrate 6, bipolar excitation microstrip lines 7, 7', a third air dielectric layer 8 and a metal reflection baseplate 9 are sequentially arranged from top to bottom in each dual-polarized antenna unit (B1, for example). The first metal radiating patch 3 is connected with the antenna cover 1 through an insulation screw 10. The ground metal patch 5 covers the upper end surface of the first dielectric substrate 6, and is fixedly connected with a hollow metal support 11 which is fixed on the metal reflection baseplate 9. The bipolar excitation microstrip lines 7, 7', of which the front ends are orthogonal yet not in contact, are arranged on the lower end surface of the first dielectric substrate 6. Two stimulated radiation micro-slots 12, 12', orthogonal but not in contact, are formed on the upper end surface of the ground metal patch, and are corresponding to the front ends of the bipolar excitation microstrip lines 7, 7' in an orthogonal way. In this embodiment, the first metal radiating patch 3 is circular, and the insulation screw 10, which is fixedly connected with the center of the first metal radiating patch 3, is also in threaded connection with the antenna cover 1 through an internal threaded hole in the center of the antenna cover 1. With such a technical scheme, the screw can be rotated outside the antenna cover for fine adjustment of the height between the first metal radiating patch and the stimulated radiation micro-slots, so that the VSWR at the I/O port of the antenna can be easily adjusted to match the impedance of the microstrip lines for a higher antenna gain. The circular metal radiating patch only has height variations during adjustment, so the adjustment is more convenient.

As shown in FIG. 11, the two stimulated radiation micro-slots 12, 12' on the ground metal patch 5 are equal in size and both H-shaped, of which the middle cross arms are orthogonal. Such a technical scheme helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are ±45°. Such a technical scheme also helps form the bipolar stimulated radiation micro-slots on the ground metal patch with a smaller area, so as to miniaturize the antenna.

According to test results, the gain of the dual-polarized antenna is 14 dBi at a test frequency of 1,900 MHz; the horizontal HPBW is 70°, the vertical HPBW is 18°, and the front-to-rear ratio is below −25 dB; the VSWR at the I/O port is below 1.3, and the relative working frequency bandwidth is around 10%.

Embodiment 11: Small Dual-polarized Microstrip Antenna

Figure 13:
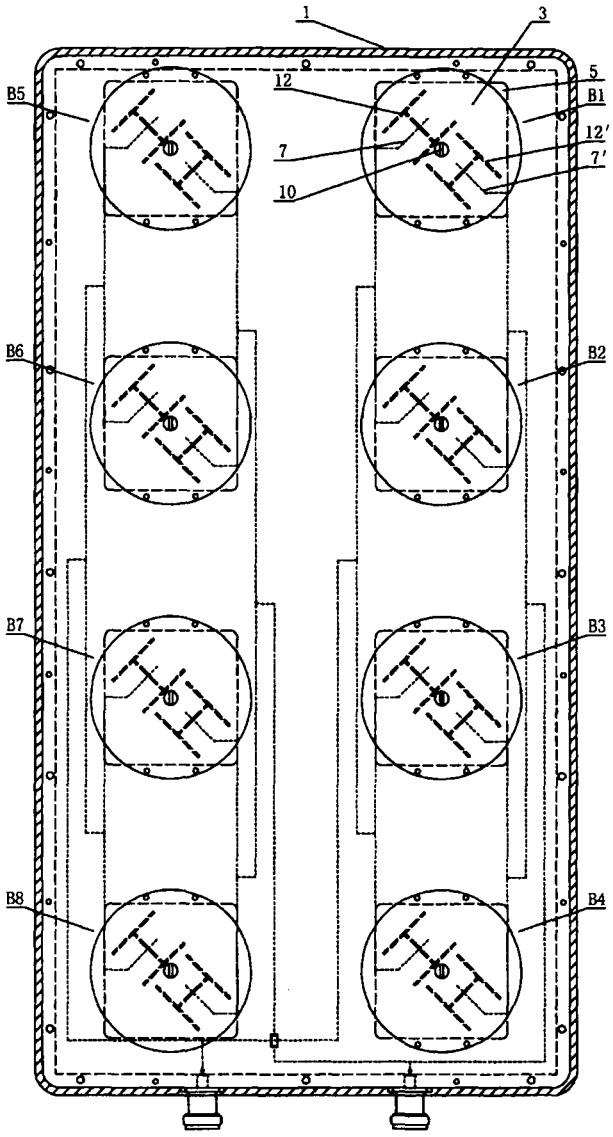
FIG. 13 is the explanatory drawing of Embodiment 13.

FIG. 13 shows a small dual-polarized microstrip antenna which is based on Embodiment 10 and further includes a second metal radiating patch 13 and a second dielectric substrate 14 in the second air dielectric layer 4. The second metal radiating patch 13 is parallel to the first metal radiating patch 3. The lower end surface of the second metal radiating patch 13 is jointed with the upper end surface of the second dielectric substrate 14 to form as a whole, which is then fixedly connected with the hollow metal support 11 fixed on the metal reflection baseplate 9 to form a fourth air dielectric layer 15 below the second dielectric substrate 14. This technical scheme helps further enlarge the working frequency bandwidth of the antenna. The second metal radiating patch 13 is circular, so that the VSWR at the I/O port of the antenna can be easily adjusted to match the impedance of the microstrip lines for a higher antenna gain.

Test results show that Embodiment 11 can enlarge the working bandwidth without changing the original electric performance indexes of the antenna according to Embodiment 10 (relative bandwidth: about 25%).

In a similar technical scheme, each dual-polarized antenna unit further includes a second metal radiating patch in the second air dielectric layer and parallel to the first metal radiating patch. The second metal radiating patch is fixed with the hollow metal support in an insulated manner, so that a fourth air dielectric layer is formed between the second metal radiating patch and the ground metal patch. The technical scheme also helps further enlarge the working frequency bandwidth of the antenna, though less remarkably without the second dielectric substrate.

Embodiment 12: Small Dual-polarized Microstrip Antenna

Figure 14:
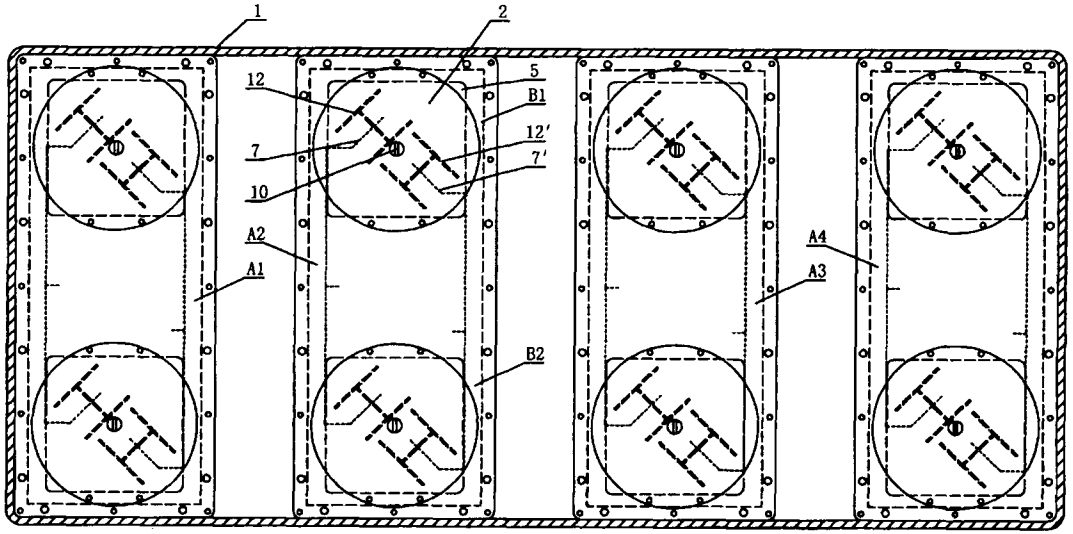
FIG. 14 is the explanatory drawing of Embodiment 14.

FIG. 14 shows a small dual-polarized microstrip antenna based on Embodiment 11, in which a third metal radiating patch 18 and a third dielectric substrate 17 are further arranged between the second metal radiating patch 13 and the first metal radiating patch 3. The third metal radiating patch 18 is parallel to the first metal radiating patch 3 and insulated from the second metal radiating patch 13 and the hollow metal support 11. The lower end surface of the third metal radiating patch 18 is jointed with the upper end surface of the third dielectric substrate 17 to form as a whole, which is then fixedly connected with an insulation support 19 fixed on the second dielectric substrate 14 to form a fifth air dielectric layer 16 below the third dielectric substrate 17.

Test results show that Embodiment 12 can further enlarge the working bandwidth without changing the original electric performance indexes of the antenna according to Embodiment 11 (relative bandwidth: about 40%).

In a similar technical scheme, the third metal radiating patch is located between the second radiating patch and the first radiating patch and parallel to the first radiating patch, and is insulated from the second metal radiating patch and the hollow metal support. A fifth air dielectric layer is formed between the third metal radiating patch and the second metal radiating patch. The technical scheme also helps further enlarge the working frequency bandwidth of the antenna, though less remarkably without the third dielectric substrate.

Embodiment 13: Small High-gain Dual-polarized Microstrip Antenna

This embodiment adopts the following technical scheme: a small high-gain dual-polarized microstrip antenna is characterized by including four dual-polarized antenna units which are connected through a four-way signal power divider and distributed in an antenna cover in two lines and two rows. A first air dielectric layer, a first metal radiating patch, a second air dielectric layer, a ground metal patch, a first dielectric substrate, bipolar excitation microstrip lines, a third air dielectric layer and a metal reflection baseplate are sequentially arranged from top to bottom in each dual-polarized antenna unit. The first metal radiating patch is connected with the antenna cover through an insulation screw. The ground metal patch covers the upper end surface of the first dielectric substrate, and is fixedly connected with a hollow metal support which is fixed on the metal reflection baseplate. The bipolar excitation microstrip lines, of which the front ends are orthogonal yet not in contact, are arranged on the lower end surface of the first dielectric substrate. Two stimulated radiation micro-slots, orthogonal but not in contact, are formed on the upper end surface of the ground metal patch, and are corresponding to the front ends of the bipolar excitation microstrip lines in an orthogonal way.

This embodiment has the following benefits: it achieves the advantages of small volume, compact structure and light weight by integrating microstrip, micro-slot and the multi-layer theory; the antenna has good energy radiation performance and high gain and reliability; with the linear arrangement and a planar emission source, microwave harnesses have better direction selectivity; with the four antenna units, the dual-polarized antenna attains a qualified gain of 14 dBi; microstrip routing inside the antenna helps reduce the consumption of connecting cables and the cost; and the antenna is more convenient to install due to its small volume and light weight. According to tests, the small high-gain dual-polarized microstrip antenna is totally qualified for operators' relevant requirements on electrical and mechanical performance indexes.

A small high-gain dual-polarized microstrip antenna according to this embodiment, as shown in FIG. 12 and FIG. 13, includes four dual-polarized antenna units (B1, B2, B3, B4) which are connected in an antenna cover 1 through a four-way power divider (dendriform series connection of three Wilkinson equal power divider, namely, one to two, and two to four). As shown in FIG. 2, a first air dielectric layer 2, a first metal radiating patch 3, a second air dielectric layer 4, a ground metal patch 5, a first dielectric substrate 6, bipolar excitation microstrip lines 7, 7', a third air dielectric layer 8 and a metal reflection baseplate 9 are sequentially arranged from top to bottom in each dual-polarized antenna unit (B1, for example). The first metal radiating patch 3 is connected with the antenna cover 1 through an insulation screw 10. The ground metal patch 5 covers the upper end surface of the first dielectric substrate 6, and is fixedly connected with a hollow metal support 11 which is fixed on the metal reflection baseplate 9. The bipolar excitation microstrip lines 7, 7', of which the front ends are orthogonal yet not in contact, are arranged on the lower end surface of the first dielectric substrate 6. Two stimulated radiation micro-slots 12, 12', orthogonal but not in contact, are formed on the upper end surface of the ground metal patch, and are corresponding to the front ends of the bipolar excitation microstrip lines 7, 7' in an orthogonal way. In this embodiment, the first metal radiating patch 3 is circular, and the insulation screw 10, which is fixedly connected with the center of the first metal radiating patch 3, is also in threaded connection with the antenna cover 1 through an internal threaded hole in the center of the antenna cover 1. With such a technical scheme, the screw can be rotated outside the antenna cover for fine adjustment of the height between the first metal radiating patch and the stimulated radiation micro-slots, so that the VSWR at the I/O port of the antenna can be easily adjusted to match the impedance of the microstrip lines for a higher antenna gain. The circular metal radiating patch only has height variations during adjustment, so the adjustment is more convenient.

As shown in FIG. 12, the two stimulated radiation micro-slots 12, 12' on the ground metal patch 5 are equal in size and both H-shaped, of which the middle cross arms are orthogonal. Such a technical scheme helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are ±45°. Such a technical scheme also helps form the bipolar stimulated radiation micro-slots on the ground metal patch with a smaller area, so as to miniaturize the antenna.

According to test results, the gain of the dual-polarized antenna is 14 dBi at a test frequency of 1,900 MHz; the horizontal HPBW is 70°, the vertical HPBW is 18°, and the front-to-rear ratio is below −25 dB; the VSWR at the I/O port is below 1.3, and the relative working frequency bandwidth is around 10%.

Embodiment 14: Small High-gain Dual-polarized Microstrip Antenna

This embodiment adopts the following technical scheme: a small high-gain dual-polarized microstrip antenna is characterized by including eight dual-polarized antenna units which are connected in an antenna cover through an eight-way signal power divider. A first air dielectric layer, a first metal radiating patch, a second air dielectric layer, a ground metal patch, a first dielectric substrate, bipolar excitation microstrip lines, a third air dielectric layer and a metal reflection baseplate are sequentially arranged from top to bottom in each dual-polarized antenna unit. The first metal radiating patch is connected with the antenna cover through an insulation screw. The ground metal patch covers the upper end surface of the first dielectric substrate, and is fixedly connected with a hollow metal support which is fixed on the metal reflection baseplate. The bipolar excitation microstrip lines, of which the front ends are orthogonal yet not in contact, are arranged on the lower end surface of the first dielectric substrate. Two stimulated radiation micro-slots, orthogonal but not in contact, are formed on the upper end surface of the ground metal patch, and are corresponding to the front ends of the bipolar excitation microstrip lines in an orthogonal way.

This embodiment has the following benefits: it achieves the advantages of small volume, compact structure and light weight by integrating microstrip, micro-slot and the multi-layer theory; the antenna has good energy radiation performance and high gain and reliability; with the linear arrangement and a planar emission source, microwave harnesses have better direction selectivity; with the eight antenna units, the dual-polarized antenna attains a qualified gain of 17 dBi; microstrip routing inside the antenna helps reduce the consumption of connecting cables and the cost; and the antenna is more convenient to install due to its small volume and light weight. According to tests, the small high-gain dual-polarized microstrip antenna is totally qualified for operators' relevant requirements on electrical and mechanical performance indexes.

A small high-gain dual-polarized microstrip antenna according to this embodiment, as shown in FIG. 13 and FIG. 14, includes eight dual-polarized antenna units (B1, B2, B3, B4, B5, B6, B7, B8) which are connected in an antenna cover 1 through an eight-way power divider (dendriform series connection of seven Wilkinson equal power divider, namely, one to two, two to four, and four to eight). As shown in FIG. 2, a first air dielectric layer 2, a first metal radiating patch 3, a second air dielectric layer 4, a ground metal patch 5, a first dielectric substrate 6, bipolar excitation microstrip lines 7, 7', a third air dielectric layer 8 and a metal reflection baseplate 9 are sequentially arranged from top to bottom in each dual-polarized antenna unit (B1, for example). The first metal radiating patch 3 is connected with the antenna cover 1 through an insulation screw 10. The ground metal patch 5 covers the upper end surface of the first dielectric substrate 6, and is fixedly connected with a hollow metal support 11 which is fixed on the metal reflection baseplate 9. The bipolar excitation microstrip lines 7, 7', of which the front ends are orthogonal yet not in contact, are arranged on the lower end surface of the first dielectric substrate 6. Two stimulated radiation micro-slots 12, 12', orthogonal but not in contact, are formed on the upper end surface of the ground metal patch, and are corresponding to the front ends of the bipolar excitation microstrip lines 7, 7' in an orthogonal way. In this embodiment, the first metal radiating patch 3 is circular, and the insulation screw 10, which is fixedly connected with the center of the first metal radiating patch 3, is also in threaded connection with the antenna cover 1 through an internal threaded hole in the center of the antenna cover 1. With such a technical scheme, the screw can be rotated outside the antenna cover for fine adjustment of the height between the first metal radiating patch and the stimulated radiation micro-slots, so that the VSWR at the I/O port of the antenna can be easily adjusted to match the impedance of the microstrip lines for a higher antenna gain. The circular metal radiating patch only has height variations during adjustment, so the adjustment is more convenient.

As shown in FIG. 13, the two stimulated radiation micro-slots 12, 12' on the ground metal patch 5 are equal in size and both H-shaped, of which the middle cross arms are orthogonal. Such a technical scheme helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are ±45°. Such a technical scheme also helps form the bipolar stimulated radiation micro-slots on the ground metal patch with a smaller area, so as to miniaturize the antenna.

According to test results, the gain of the dual-polarized antenna is 17 dBi at a test frequency of 1,900 MHz; the horizontal HPBW is 70°, the vertical HPBW is 18°, and the front-to-rear ratio is below −25 dB; the VSWR at the I/O port is below 1.3, and the relative working frequency bandwidth is around 10%.

Embodiment 15: Eight-channel High-isolation Dual-polarized Smart Array Antenna

This embodiment adopts the following technical scheme: an eight-channel high-isolation dual-polarized smart array antenna includes four independent dual-polarized antenna in an antenna cover, and is characterized in that: each dual-polarized antenna includes two dual-polarized antenna units connected through a two-way power divider; a first air dielectric layer, a first metal radiating patch, a second air dielectric layer, a ground metal patch, a first dielectric substrate, bipolar excitation microstrip lines, a third air dielectric layer and a metal reflection baseplate are sequentially arranged from top to bottom in each dual-polarized antenna unit; the first metal radiating patch is connected with the antenna cover through an insulation screw; the ground metal patch covers the upper end surface of the first dielectric substrate, and is fixedly connected with a hollow metal support which is fixed on the metal reflection baseplate; the bipolar excitation microstrip lines, of which the front ends are orthogonal yet not in contact, are arranged on the lower end surface of the first dielectric substrate; and two stimulated radiation micro-slots, orthogonal but not in contact, are formed on the upper end surface of the ground metal patch, and are corresponding to the front ends of the bipolar excitation microstrip lines in an orthogonal way.

This embodiment has the following benefits: it achieves the advantages of small volume, compact structure and light weight by integrating microstrip, micro-slot and the multi-layer theory; the antenna has good energy radiation performance and high reliability; with the linear arrangement and a planar emission source, microwave harnesses have better direction selectivity; with the two antenna units in each dual-polarized antenna, the gain can reach 11 dBi, which is qualified for small areas with a high user density, such as urban residential communities, commercial buildings, etc; microstrip routing inside the antenna helps reduce the consumption of connecting cables and the cost; and the antenna is more convenient to install due to its small volume and light weight—it can be directly installed on the conventional 3G smart antenna installation support without a holder, thus greatly reducing the installation input and the expense for future maintenance. The eight-channel high-isolation dual-polarized smart array antenna is suitable for small areas with a high user density, such as urban residential communities, commercial buildings, etc., and is tested as totally qualified for operators' relevant requirements on electrical and mechanical performance indexes. Instead of the conventional idea and model of the present half-wave element smart antennas, the antenna units with a high unit gain form an antenna array, which makes the antenna much smaller and lighter without changing the original performance indexes, that is, the antenna is miniaturized. It can replace 3G antennas in the market and will strongly challenge 4G antennas. The miniaturized antenna according to the utility model may be applied in residential communities, so as to eliminate and mitigate the concerts of nearby residents that large antennas are harmful because of radiation.

Figure 15:
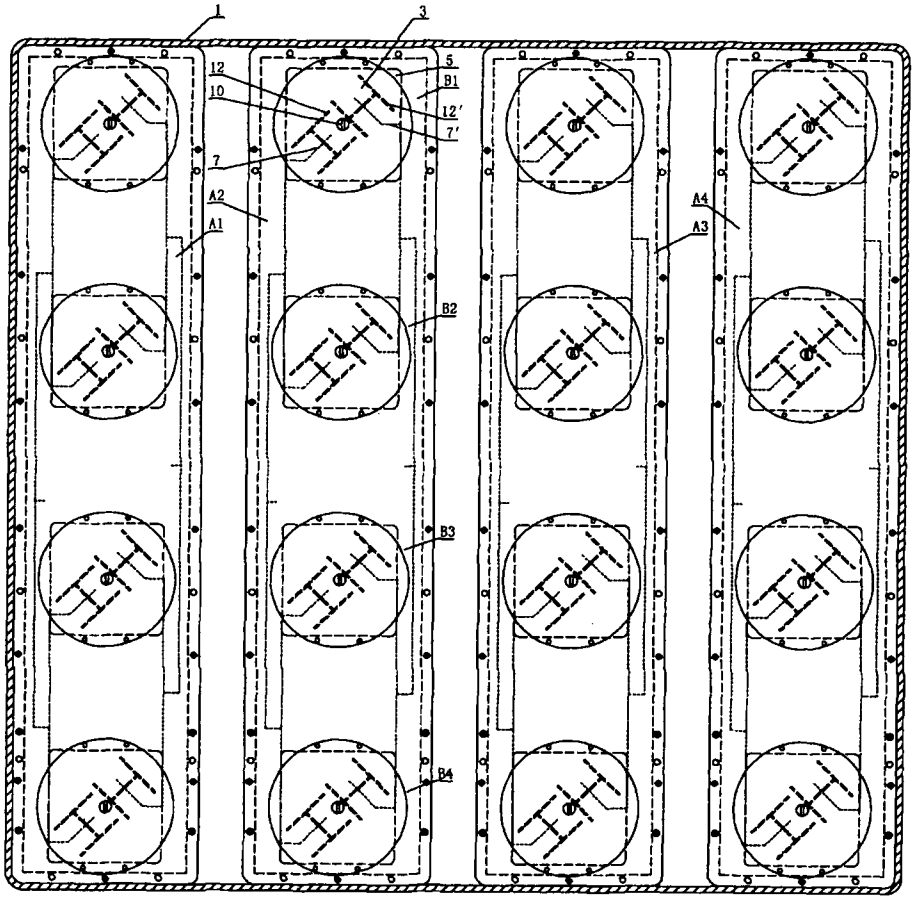
FIG. 15 is the explanatory drawing of Embodiment 15.

An eight-channel high-isolation dual-polarized smart array antenna according to this embodiment, as shown in FIG. 14 and FIG. 15, includes four independent dual-polarized antenna (A1, A2, A3, A4) in an antenna cover 1. Each dual-polarized antenna (A2, for example) includes two dual-polarized antenna units (B1, B2) which are connected through a two-way power divider (Wilkinson equal power divider). As shown in FIG. 2, a first air dielectric layer 2, a first metal radiating patch 3, a second air dielectric layer 4, a ground metal patch 5, a first dielectric substrate 6, bipolar excitation microstrip lines 7, 7', a third air dielectric layer 8 and a metal reflection baseplate 9 are sequentially arranged from top to bottom in each dual-polarized antenna unit (B1, for example). The first metal radiating patch 3 is connected with the antenna cover 1 through an insulation screw 10. The ground metal patch 5 covers the upper end surface of the first dielectric substrate 6, and is fixedly connected with a hollow metal support 11 which is fixed on the metal reflection baseplate 9. The bipolar excitation microstrip lines 7, 7', of which the front ends are orthogonal yet not in contact, are arranged on the lower end surface of the first dielectric substrate 6. Two stimulated radiation micro-slots 12, 12', orthogonal but not in contact, are formed on the upper end surface of the ground metal patch, and are corresponding to the front ends of the bipolar excitation microstrip lines 7, 7' in an orthogonal way. In this embodiment, the first metal radiating patch 3 is circular, and the insulation screw 10, which is fixedly connected with the center of the first metal radiating patch 3, is also in threaded connection with the antenna cover 1 through an internal threaded hole in the center of the antenna cover 1. With such a technical scheme, the screw can be rotated outside the antenna cover for fine adjustment of the height between the first metal radiating patch and the stimulated radiation micro-slots, so that the VSWR at the I/O port of the antenna can be easily adjusted to match the impedance of the microstrip lines for a higher antenna gain. The circular metal radiating patch only has height variations during adjustment, so the adjustment is more convenient.

As shown in FIG. 14, the two stimulated radiation micro-slots 12, 12' on the ground metal patch 5 are equal in size and both H-shaped, of which the middle cross arms are orthogonal. Such a technical scheme helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are ±45°. Such a technical scheme also helps form the bipolar stimulated radiation micro-slots on the ground metal patch with a smaller area, so as to miniaturize the antenna.

According to test results, the two ports of the dual-polarized antenna are satisfactorily isolated from each other (isolation >30 dB) and thus can work independently; the antenna gain is 11 dBi at a test frequency of 1,900 MHz; the horizontal HPBW is 72°, the vertical HPBW is 36°, and the front-to-rear ratio is below −25 dB; the VSWR at the I/O port is below 1.3, and the relative working frequency bandwidth is around 10%.

Embodiment 16: Eight-channel High-gain High-isolation Dual-polarized Smart Array Antenna This embodiment adopts the following technical scheme: an eight-channel high-gain high-isolation dual-polarized smart array antenna includes four independent dual-polarized antenna in an antenna cover, and is characterized in that: each dual-polarized antenna includes four dual-polarized antenna units connected through a four-way power divider; a first air dielectric layer, a first metal radiating patch, a second air dielectric layer, a ground metal patch, a first dielectric substrate, bipolar excitation microstrip lines, a third air dielectric layer and a metal reflection baseplate are sequentially arranged from top to bottom in each dual-polarized antenna unit; the first metal radiating patch is connected with the antenna cover through an insulation screw; the ground metal patch covers the upper end surface of the first dielectric substrate, and is fixedly connected with a hollow metal support which is fixed on the metal reflection baseplate; the bipolar excitation microstrip lines, of which the front ends are orthogonal yet not in contact, are arranged on the lower end surface of the first dielectric substrate; and two stimulated radiation micro-slots, orthogonal but not in contact, are formed on the upper end surface of the ground metal patch, and are corresponding to the front ends of the bipolar excitation microstrip lines in an orthogonal way.

This embodiment has the following benefits: it achieves the advantages of small volume, compact structure and light weight by integrating microstrip, micro-slot and the multi-layer theory; the antenna has good energy radiation performance and high reliability; with the linear arrangement and a planar emission source, microwave harnesses have better direction selectivity; with the four antenna units in each dual-polarized antenna, the gain can reach 14 dBi, which meets the coverage requirement of mobile communication base stations and solves the signal coverage in urban, suburban and rural areas with different landscapes, numbers of users, occasions and ranges; microstrip routing inside the antenna helps reduce the consumption of connecting cables and the cost;

and the antenna is more convenient to install due to its small volume and light weight—it can be directly installed on the conventional 3G smart antenna installation support without a holder, thus greatly reducing the installation input and the expense for future maintenance. The eight-channel high-isolation dual-polarized smart array antenna is suitable for the establishment of mobile communication base stations, and is tested as totally qualified for operators' relevant requirements on electrical and mechanical performance indexes. Instead of the conventional idea and model of the present half-wave element smart antennas, the antenna units with a high unit gain form an antenna array, which makes the antenna much smaller and lighter without changing the original performance indexes, that is, the antenna is miniaturized. It can replace 3G antennas in the market and will strongly challenge 4G antennas.

Figure 16:
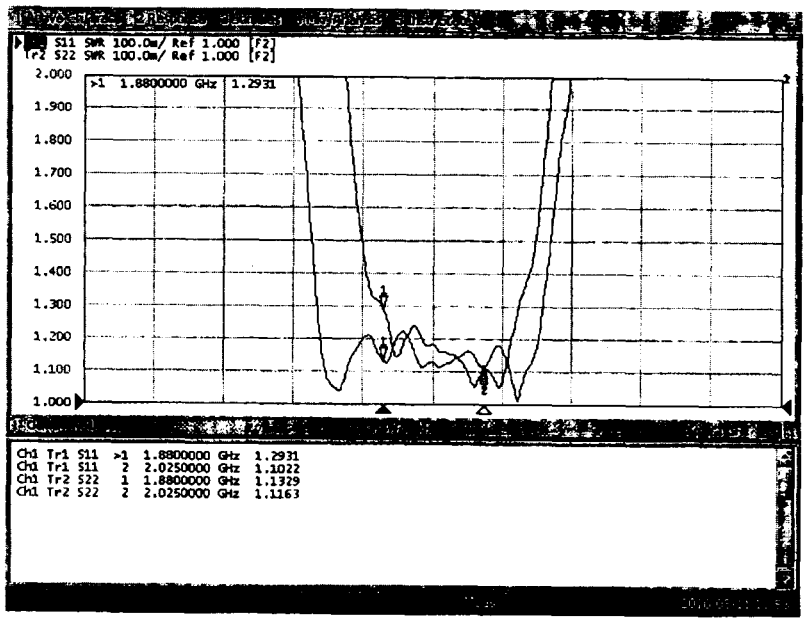
FIG. 16 is the standing wave pattern of a set of dual-polarized channels.
Figure 17:
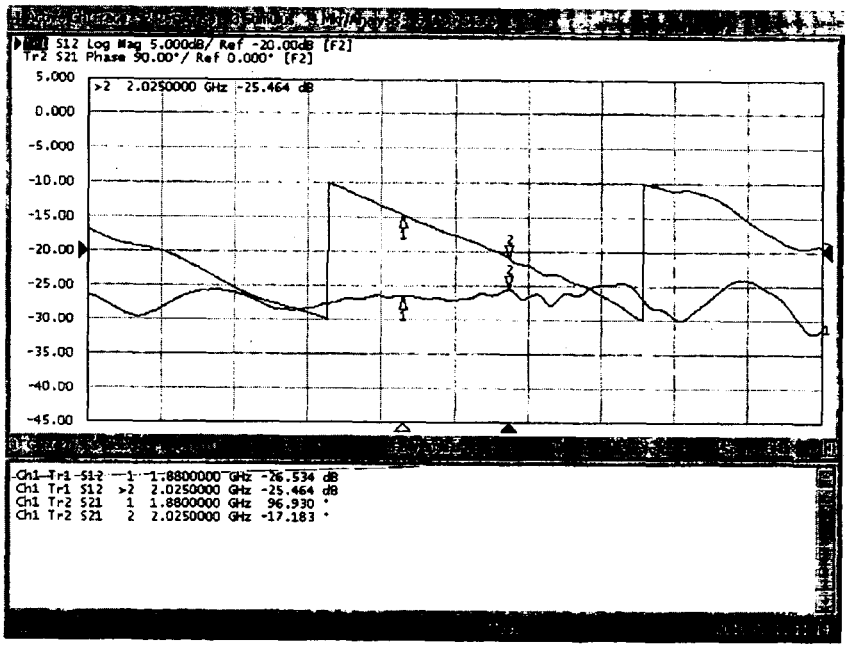
FIG. 17 is the amplitude phase diagram of a calibration channel.
Figure 18:
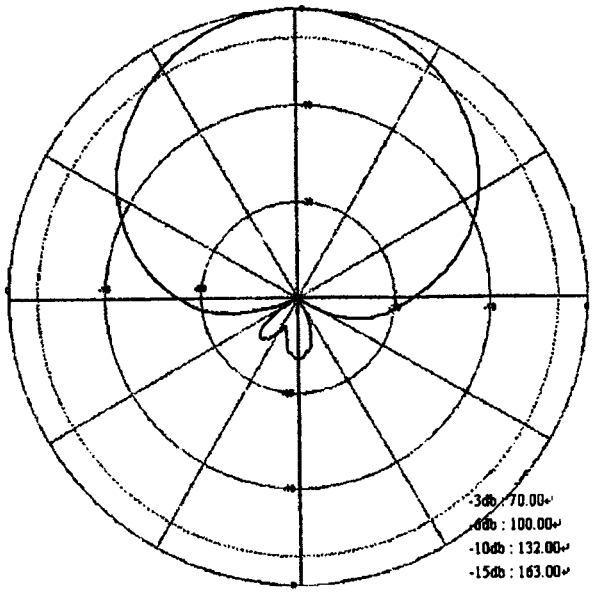
FIG. 18 is the measured drawing of a single port in the horizontal direction.
Figure 19:
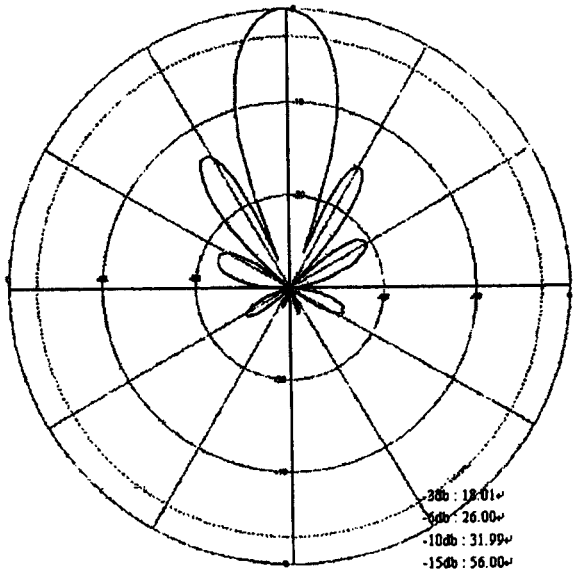
FIG. 19 is the measured drawing of a single port in the vertical direction.
Figure 20:
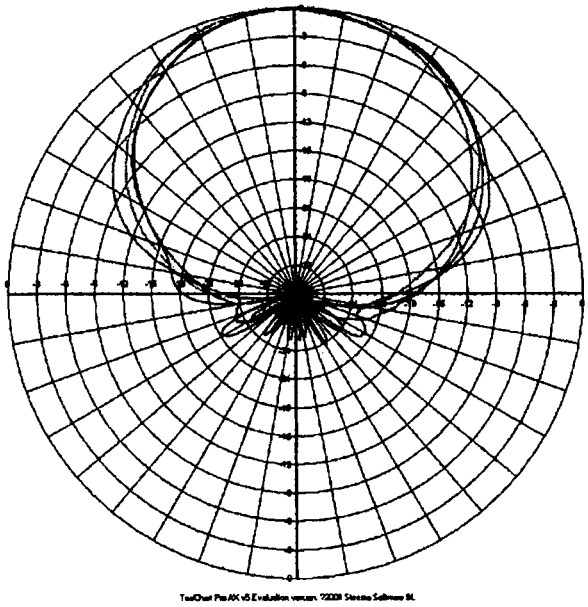
FIG. 20 is the measured drawing of ports 1, 3, 5, 7 in the horizontal direction.
Figure 21:
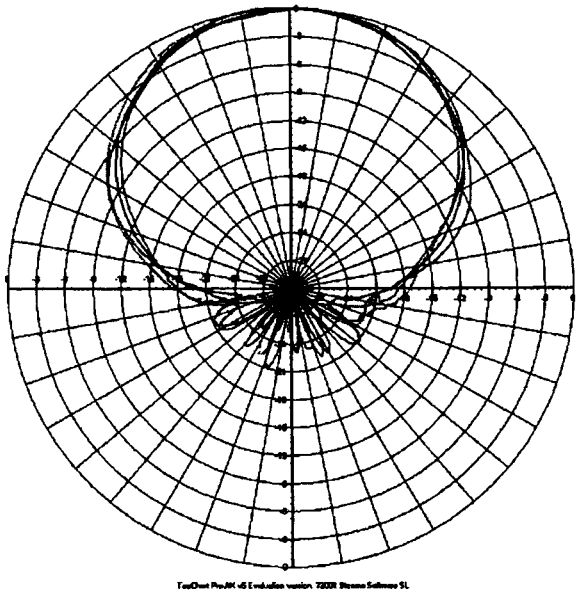
FIG. 21 is the measured drawing of ports 2, 4, 6, 8 in the horizontal direction.

An eight-channel high-gain high-isolation dual-polarized smart array antenna according to this embodiment, as shown in FIG. 15 and FIG. 16, includes four independent dual-polarized antenna (A1, A2, A3, A4) in an antenna cover 1. Each dual-polarized antenna (A2, for example) includes four dual-polarized antenna units (B1, B2, B3, B4) which are connected through a four-way power divider (series connection of three Wilkinson equal power divider). As shown in FIG. 2, a first air dielectric layer 2, a first metal radiating patch 3, a second air dielectric layer 4, a ground metal patch 5, a first dielectric substrate 6, bipolar excitation microstrip lines 7, 7', a third air dielectric layer 8 and a metal reflection baseplate 9 are sequentially arranged from top to bottom in each dual-polarized antenna unit (B1, for example). The first metal radiating patch 3 is connected with the antenna cover 1 through an insulation screw 10. The ground metal patch 5 covers the upper end surface of the first dielectric substrate 6, and is fixedly connected with a hollow metal support 11 which is fixed on the metal reflection baseplate 9. The bipolar excitation microstrip lines 7, 7', of which the front ends are orthogonal yet not in contact, are arranged on the lower end surface of the first dielectric substrate 6. Two stimulated radiation micro-slots 12, 12', orthogonal but not in contact, are formed on the upper end surface of the ground metal patch, and are corresponding to the front ends of the bipolar excitation microstrip lines 7, 7' in an orthogonal way. In this embodiment, the first metal radiating patch 3 is circular, and the insulation screw 10, which is fixedly connected with the center of the first metal radiating patch 3, is also in threaded connection with the antenna cover 1 through an internal threaded hole in the center of the antenna cover 1. With such a technical scheme, the screw can be rotated outside the antenna cover for fine adjustment of the height between the first metal radiating patch and the stimulated radiation micro-slots, so that the VSWR at the I/O port of the antenna can be easily adjusted to match the impedance of the microstrip lines for a higher antenna gain. The circular metal radiating patch only has height variations during adjustment, so the adjustment is more convenient.

As shown in FIG. 15, the two stimulated radiation micro-slots 12, 12' on the ground metal patch 5 are equal in size and both H-shaped, of which the middle cross arms are orthogonal. Such a technical scheme helps form the bipolar stimulated radiation micro-slots on the ground metal patch with a smaller area, so as to miniaturize the antenna. The included angles between the middle cross arms of the two H-shaped stimulated radiation micro-slots 12, 12' and the X/Y axis of the ground metal patch are ±45°. Such a technical scheme also helps form the bipolar stimulated radiation micro-slots on the ground metal patch with a smaller area, so as to miniaturize the antenna.

According to test results, the two ports of the dual-polarized antenna are satisfactorily isolated from each other (isolation >30 dB) and thus can work independently; the antenna gain is 14 dBi at a test frequency of 1,900 MHz; the horizontal HPBW is 70°, the vertical HPBW is 18°, and the front-to-rear ratio is below −25 dB; the VSWR at the I/O port is below 1.3, and the relative working frequency bandwidth is around 10%.

Embodiment 17: TD-LTE Network Antenna

In view of the problems in communication network construction that arise from the large size of smart antennas, and on the basis of the research findings of this invention on miniaturization, higher radiation efficiency and dual polarization of single antenna elements, the product according to this embodiment aims to improve a number of problems caused by the present large antennas, such as difficulty in engineering construction, etc., and relates to a miniaturized TD-LTE eight-channel dual-polarized smart antenna subjected to internal confidential tests.

According to the fact that electromagnetic wave has different transmission characteristics in different mediums, the antenna is filled with a low-loss high-frequency medium, and adopts the structure of two or more layers of radiating patches and the shape of components, dielectric constant and feeding method in Embodiment 17, so as to greatly reduce the physical dimensions and further achieve the multi-frequency, multi-model and miniaturized effects.

Unlike the conventional half-wave element type antennas, this embodiment adopts the microwave aperture-coupled multi-cavity laminated plane microstrip radiation mechanism for a high unit element gain (the unit gain of the MM antenna is 8.5 dBi, in contrast to an ordinary unit element gain of 5.5 dBi). The horizontal and vertical beam widths both range from 75 to 80°, and the front-to-rear ratio is above 25 dB.

This invention may be implemented in other ways except the above embodiments. Technical schemes from identical replacement or equivalent transformation should by no means fall in the protection scope as claimed by this invention.

The invention claimed is:

1. A dual-polarized microstrip antenna comprising:

at least a first metal radiating patch having a screw fixedly connected with a center thereof;

at least one ground metal layer whereon excitation micro-slots are etched;

at least a first dielectric layer, which is a resonant dielectric layer, wherein the dielectric layer is positioned between the first metal radiating patch and the ground metal layer, the first metal radiating patch is circular and the screw is in threaded connection with an antenna cover through an internal threaded hole in a center of the antenna cover; and at least one set of bipolar excitation microstrip lines, wherein the excitation micro-slots are two discretely vertical H-shaped excitation micro-slots with the same dimensions, that is, the two H-shaped excitation micro-slots are not in contact and the H-shaped excitation micro-slots are identical in dimensions so as to ensure that the dual-polarized antenna has consistent radiation performance optimization in the two polarization directions, and wherein angles between middle cross arms of the two H-shaped excitation micro-slots and an X-Y axis of the ground metal layer are ±45°.

2. The dual-polarized microstrip antenna according to claim 1, further comprising an independent VSWR adjustment unit connected with the first metal radiating patch.

3. The dual-polarized microstrip antenna according to claim 1, wherein the thickness of the dielectric layer ranges from 1 to 40 mm; and a dielectric substrate is arranged between the bipolar excitation microstrip lines and the ground metal layer, and the thickness of the dielectric substrate ranges from 0.2 to 5 mm.

4. The dual-polarized microstrip antenna according to claim 3, wherein the thickness of the dielectric layer ranges from 2 to 10 mm; and the thickness of the dielectric substrate ranges from 0.5 to 2 mm.

5. The dual-polarized microstrip antenna according to claim 1, wherein front ends of the two excitation microstrip lines are linear; the front ends of the two excitation microstrip lines are discretely vertical for the purposes of guaranteeing the polarization isolation of the dual-polarized antenna and leading it to be used as two independent antennas; the distance between the two discrete front ends, which are not in contact ranges from 1 to 8 mm; and the perpendicularity between the two discrete front ends which are not in contact, ranges from 60 to 90°.

6. The dual-polarized microstrip antenna according to claim 5, wherein the front end of each excitation microstrip line is vertical to the cross arm "-" of one H-shaped excitation micro-slot, and the front ends pass through the middle points of the cross arms "-" of the respective H-shaped excitation micro-slots.

7. The dual-polarized microstrip antenna according to claim 1, wherein the two H-shaped excitation micro-slots are identical in size, width, slot depth, slot width and shape, and two ends of the single cross arm "-" of each H-shaped excitation micro-slot intersect with middle points of the two vertical arms "|", and the single cross arm "-" and the two vertical arms "|" of each H-shaped excitation micro-slot are linear.

8. The dual-polarized microstrip antenna according to claim 7, further comprising a second dielectric layer, wherein the second dielectric layer is a resonant dielectric layer.

9. The dual-polarized microstrip antenna according to claim 8, wherein the second dielectric layer comprises a slot cavity used to prevent the impact among arrays during the arrayed use of the antenna; and wherein the height of the slot cavity depends on the relevance/isolation parameters determined in an ultimate antenna application.

10. The dual-polarized microstrip antenna according to claim 9, wherein the slot cavity is formed above the ground metal layer by a metal support for system ground, of which the depth ranges from 0.5 to 20 mm; and wherein when the first and the second dielectric layers are air layers and no other radiating patches or components are arranged above the second dielectric layer, the first and the second dielectric layers are connected into a whole and the second dielectric layer serves as one part of the first dielectric layer.

11. The dual-polarized microstrip antenna according to claim 6, wherein the heights and lengths of the radiating patch, the dielectric layers, and the ground metal layer are determined based on frequency band and wavelength.

12. The dual-polarized microstrip antenna according to claim 11, further comprising a second metal radiating patch, wherein the second metal radiating patch is identical to the first metal radiating patch in material, thickness and shape; and a size of the second metal radiating patch is freely optimized according to the requirements for widening the frequency band such that the size of the second metal radiating patch is ±20% of that of the first metal radiating patch.

13. The dual-polarized microstrip antenna according to claim 12, further comprising: an air dielectric layer, namely air dielectric layer A, providing an undisturbed work space height for the excitation microstrip lines interfaced with a source, wherein the work space height exceeds λ/N when N is about 10-8.

14. The dual-polarized microstrip antenna according to claim 13, further comprising a metal reflection ground baseplate for providing excellent backward radiation isolation for radiating units and providing convenient system ground for source parts, feed source parts or radiating units.

15. The dual-polarized microstrip antenna according to claim 12, wherein the second metal radiating patch is arranged above the second dielectric layer so as to separate the first dielectric layer into two areas being a lower part and an upper part, where the lower part is the slot cavity and the upper part is a first dielectric layer area between the first and the second metal radiating patches.

16. The dual-polarized microstrip antenna according to claim 8, wherein the second dielectric is a resonant dielectric layer of air or a layer of other optimization resonant materials.

17. The dual-polarized microstrip antenna according to claim 7, wherein the single cross arm "-" of each H-shaped excitation micro-slot is vertical to the two vertical arms "|" thereof; the virtual extension line of the cross arm "-" of at least one H-shaped excitation micro-slot squarely passes through the middle point of the cross arm "-" of the other H-shaped excitation micro-slot.

18. The dual-polarized microstrip antenna according to claim 7, wherein at least one straight line passing through the central point of the first metal radiating patch is positioned on the vertical surface of the cross arm "-" of at least one H-shaped excitation micro-slot, the vertical surface squarely passes through the middle point of the cross arm "-" of the other H-shaped excitation micro-slot, and the vertical surface is vertical to the plane on which the slot bottom of the former H-shaped excitation micro-slot is positioned.

19. The dual-polarized microstrip antenna according to claim 7, wherein the slot bottoms of the two H-shaped excitation micro-slots are on the same plane and the slot surfaces of the two H-shaped excitation micro-slots are on the same plane.

20. The dual-polarized microstrip antenna according to claim 7, wherein, in an area of the same shape and size on the ground metal layer vertically projected by the first metal radiating patch, each H-shaped excitation micro-slot independently occupies half the area of the same shape and size, each H-shaped excitation micro-slot or the length of the cross arm "-" of each H-shaped excitation micro-slot or the total length of the cross arm "-" and the two vertical arms "|" of each H-shaped excitation micro-slot is maximized, and the total slot area of each cross arm "-" and the two vertical arms "|" of each H-shaped excitation micro-slot is maximized.

21. The wireless communication relay station employing the dual-polarized microstrip antenna in accordance with claim 1, including at least one dual-polarized microstrip antenna, wherein an input port of the dual-polarized microstrip antenna is connected with a retransmission end of a relay station.

22. A wireless communication base station employing the dual-polarized microstrip antenna in accordance with claim 1, comprising at least one dual-polarized microstrip antenna.

23. A communication system employing the dual-polarized microstrip antenna in accordance with claim 1, comprising at least one piece of equipment equipped with the dual-polarized microstrip antenna.

24. A dual-polarized microstrip antenna comprising at least two dual-polarized antenna units connected together through a power divider, wherein each dual-polarized antenna comprises: a first air dielectric layer, a first metal radiating patch, a second air dielectric layer, a ground metal patch, a first dielectric substrate, bipolar excitation microstrip lines, a third air dielectric layer and a metal reflection baseplate, that are sequentially arranged from top to bottom, wherein the first metal radiating patch is connected with an antenna cover through an insulation screw, the ground metal patch covers an upper end surface of the first dielectric substrate and is fixedly connected with a hollow metal support fixed on the metal reflection baseplate, bipolar excitation microstrip lines, of which the front ends are orthogonal but not in contact, are arranged on a lower end surface of the first dielectric substrate, and two stimulated radiation micro-slots, orthogonal but not in contact, are formed on the upper end surface of the ground metal patch and correspond to the front ends of the bipolar excitation microstrip lines in an orthogonal way, the screw is fixedly connected with a center of the first metal radiating patch and is in threaded connection with the antenna cover through an internal threaded hole at a center of the antenna cover.

25. The dual-polarized microstrip antenna according to claim 24, comprising four dual-polarized antenna units connected together through the power divider in an antenna cover, wherein the power divider is a four-way power divider and wherein the four dual-polarized antenna units are distributed in a line in the antenna cover.

26. The dual-polarized microstrip antenna according to claim 24, comprising four dual-polarized antenna units connected together through the power divider in an antenna cover, wherein the power divider is a four-way power divider and wherein the four dual-polarized antenna units are distributed in two lines and two rows in the antenna cover.

27. The dual-polarized microstrip antenna according to claim 24, comprising: two independent dual-polarized antennas in an antenna cover, wherein each dual-polarized antenna includes two of the dual-polarized antenna units connected together through the power divider, and wherein the power divider is a two-way power divider.

28. The dual-polarized microstrip antenna according to claim 24, comprising: eight of the dual-polarized antenna units connected in an antenna cover through the power divider, wherein the power divider is an eight-way power divider.

29. The dual-polarized microstrip antenna according to claim 24, comprising: four independent dual-polarized antennas in an antenna cover, wherein the dual-polarized antenna comprises two of the dual-polarized antenna units connected together through the power divider, wherein the power divider is a two-way power divider.

30. The dual-polarized microstrip antenna according to claim 24, comprising: four independent dual-polarized antennas in an antenna cover, the dual-polarized antenna comprising four of the dual-polarized antenna units connected together through the power divider, wherein the power divider is a four-way power divider.

31. A dual-polarized microstrip antenna comprising: a first air dielectric layer, a first metal radiating patch, a second air dielectric layer, a ground metal patch, a first dielectric substrate, excitation microstrip lines, a third air dielectric layer and a metal reflection baseplate, all being sequentially arranged from top to bottom in an antenna cover, wherein the ground metal patch covers the upper end surface of the first dielectric substrate and is fixedly connected with a hollow metal support fixed on the metal reflection baseplate, stimulated radiation micro-slots are formed on the upper end surface of the round metal patch, the first metal radiating patch is circular, where an adjusting screw is fixed in the center, and the first metal radiating patch is fixed through the threaded connection between the adjusting screw and the internal threads in the center of the antenna cover.

* * * * *

UNITED STATES PATENT AND TRADEMARK OFFICE

CERTIFICATE OF CORRECTION

PATENT NO. : 9,030,364 B2
APPLICATION NO. : 13/639958
DATED : May 12, 2015
INVENTOR(S) : Kunjie Zhuang It is certified that error appears in the above-identified patent and that said Letters Patent is hereby corrected as shown below:

In the Claims

Column 33, Line 51, Claim 11, delete "claim 7," and insert -- claim 8, --

Signed and Sealed this
Twenty-seventh Day of October, 2015

Michelle K. Lee

Michelle K. Lee
*Director of the United States Patent and Trademark Office*